US011688976B2

(12) United States Patent
Gruendler et al.

(10) Patent No.: US 11,688,976 B2
(45) Date of Patent: Jun. 27, 2023

(54) ELECTRICAL CONNECTOR AND PLUG-IN CONNECTION, HIGH VOLTAGE SYSTEM AND METHOD FOR LOCKING AN ELECTRICAL PLUG-IN CONNECTION

(71) Applicant: Rosenberger Hochfrequenztechnik GmbH & Co. KG, Fridolfing (DE)

(72) Inventors: Stefan Markus Gruendler, Tacherting (DE); Simon Stoehr, Kirchdorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 92 days.

(21) Appl. No.: 17/271,949

(22) PCT Filed: Sep. 3, 2019

(86) PCT No.: PCT/EP2019/073443
§ 371 (c)(1),
(2) Date: Feb. 26, 2021

(87) PCT Pub. No.: WO2020/048964
PCT Pub. Date: Mar. 12, 2020

(65) Prior Publication Data

US 2021/0296820 A1 Sep. 23, 2021

(30) Foreign Application Priority Data

Sep. 3, 2018 (DE) ..... 10 2018 121 399.9

(51) Int. Cl.
*H01R 13/629* (2006.01)
*H01R 13/639* (2006.01)

(52) U.S. Cl.
CPC . *H01R 13/62938* (2013.01); *H01R 13/62955* (2013.01); *H01R 13/639* (2013.01); *H01R 2201/26* (2013.01)

(58) Field of Classification Search
CPC ..... H01R 13/62933; H01R 13/62938; H01R 13/62955; H01R 13/62988; H01R 13/639;
(Continued)

(56) References Cited

U.S. PATENT DOCUMENTS 5,174,786 A * 12/1992 Kato ..... H01R 13/641 439/352
6,435,895 B1 * 8/2002 Fink ..... H01R 13/6272 439/352
(Continued)

FOREIGN PATENT DOCUMENTS

EP 0124389 A1 11/1984
EP 1093191 A2 4/2001
(Continued)

OTHER PUBLICATIONS

German Search Report dated Aug. 27, 2019.
(Continued)

*Primary Examiner* — Thanh Tam T Le
(74) *Attorney, Agent, or Firm* — Randall Danskin P.S.

(57) ABSTRACT

An electrical connector has a connector housing, a securing element and an actuating element movable between a home position and a locking position and which is designed to lock the electrical connector with a corresponding electrical counterpart connector. The connector housing has a locking guide for guiding the securing element between an initial position, and a securing position, wherein the securing element engages with the actuating element so that the actuating element is locked in the locking position. The securing element has a latching tab and the locking guide has a first stop for the latching tab to block the securing element in the initial position. The actuating element has a releasing
(Continued)

body which penetrates into a recess in the locking guide to displace the latching tab of the securing element, to release the securing element.

20 Claims, 11 Drawing Sheets

(58) Field of Classification Search
CPC ..... H01R 13/641; H01R 13/6271; H01R 13/6272; H01R 13/6275; H01R 2201/26
See application file for complete search history.

(56) References Cited

U.S. PATENT DOCUMENTS

| | | | | |
|---|---|---|---|---|
| 6,623,287 | B2 * | 9/2003 | Hatagishi | H01R 13/62933 439/157 |
| 6,679,711 | B2 * | 1/2004 | Takahashi | H01R 13/62938 439/153 |
| 6,780,045 | B2 | 8/2004 | Shuey | |
| 6,793,522 | B2 * | 9/2004 | Yamashita | H01R 13/6295 439/157 |
| 7,044,758 | B2 * | 5/2006 | Deno | H01R 13/641 439/157 |
| 7,052,294 | B1 * | 5/2006 | Osada | H01R 13/62955 439/157 |
| 7,384,258 | B2 | 6/2008 | Kuwahara | |
| 7,396,240 | B2 * | 7/2008 | Frederiksen | H01R 13/639 439/157 |
| 7,396,242 | B2 | 7/2008 | Dekoski | |
| 7,462,067 | B1 | 12/2008 | Whiteman | |
| 8,641,433 | B2 * | 2/2014 | Uchida | H01R 13/62955 439/372 |
| 8,926,189 | B2 | 1/2015 | Margrave | |
| 8,998,631 | B2 | 4/2015 | Gorman | |
| 9,093,786 | B2 | 7/2015 | Forell | |
| 10,014,628 | B2 * | 7/2018 | Mito | H01R 13/4538 |
| 10,135,183 | B1 * | 11/2018 | Probert | H01R 13/62966 |
| 10,218,117 | B1 * | 2/2019 | Probert | H01R 12/712 |
| 10,263,367 | B2 * | 4/2019 | Nicolas | H01R 13/62955 |
| 10,290,973 | B1 * | 5/2019 | Gisoldi | H01R 13/62955 |
| 10,374,356 | B2 * | 8/2019 | Amerio | H01R 13/62944 |
| 10,559,919 | B2 * | 2/2020 | Masuda | H01R 13/193 |
| 2015/0295352 | A1 | 10/2015 | Kim | |

FOREIGN PATENT DOCUMENTS

| | | | |
|---|---|---|---|
| EP | 1689046 | A1 | 8/2006 |
| EP | 3206264 | A1 | 8/2017 |
| GB | 2270805 | A | 3/1994 |
| JP | 2002270294 | A | 9/2002 |

OTHER PUBLICATIONS

Miscellaneous PCT/EP2019/073443 Documents.
Office Action issued by the State Intellectual Property Office of China dated Sep. 13, 2022.

* cited by examiner

ELECTRICAL CONNECTOR AND PLUG-IN CONNECTION, HIGH VOLTAGE SYSTEM AND METHOD FOR LOCKING AN ELECTRICAL PLUG-IN CONNECTION

RELATED APPLICATIONS

This US National Phase Utility Patent Application claims priority to German Patent Application No. 10 2018 121 399.9 which was filed on 3 Sep. 2018, and also claims priority to PCT Patent Application No. PCT/EP2019/073443 which was filed on 3 Sep. 2019 and which was published as WO 20201048964 A1 on 12 Mar. 2020. The entire contents of the aforementioned German Patent Application, the aforementioned PCT Patent Application and the aforementioned PCT Publication are all expressly and fully incorporated herein by this reference. This claim of priority is also being made in, and is set forth in, the Application Data Sheet (ADS) filed contemporaneously herewith.

BACKGROUND

The present invention relates to an electrical connector, having a connector housing, a securing element and an actuating element that is movable between a home position and a locking position.

The invention additionally relates to an electrical plug-in connection comprising an electrical connector and an electrical mating connector corresponding to the electrical connector.

The invention also relates to a high-voltage system, in particular for a motor vehicle, comprising an electrical plug-in connection.

The invention further relates to a method for locking an electrical plug-in connection composed of a connector and a mating connector.

A large number of electrical connectors, in particular electrical pin headers, are known from electrical engineering. As is known, the electrical connectors serve to transmit electrical energy and/or signals with as wide a bandwidth as possible, in particular to corresponding mating connectors.

Electrical connectors have contact means in many different embodiments. Pin contacts and/or male contacts, in particular, are common. Regardless of the specific design, the various connectors are referred to in the following as electrical connectors.

An electrical connector, or an electrical mating connector, may be a plug, a built-in plug, a socket, a coupling or an adapter. The term "connector", or "mating connector", used in the context of the invention represents all variants.

Connectors for the automotive industry, in particular, are subject to stringent specifications with regard to their robustness and the safety of the plug-in connections. Thus, a plug-in connection must sometimes be able to withstand high loads, for example mechanical loads, and remain closed in a defined manner. It must be ensured that the electrical connection is not disconnected unintentionally, for example during the operation of a vehicle. Moreover, the connectors also have to assure a faultless transmission of electrical power, signals and/or data in contaminated, damp and/or chemically aggressive environments.

The assurance of safety is a priority, in particular, for autonomous vehicle operation and assistance systems.

Electrical connectors, or their connector bodies, may be fitted on an electrical line, a wiring harness, a cable or an electrical device such as, for example, a housing of an electronic or electrical device.

Also in the high-voltage range, in particular, electrical connectors are subject to particular requirements. High-voltage connectors are used in the automotive sector, especially in electric and/or hybrid vehicles, to supply a high-voltage battery with charging current or to extract the stored energy from the battery. Thus, for example, connectors suitable for high-voltage connections are used for supply units such as, for example, a charging box in a garage or carport, or also at electricity charging stations, in order to supply a high-voltage battery of a vehicle with charging current. The electrical connector in this case must permanently and reliably prevent the ingress of moisture and dirt, and ensure faultless transmission of the electrical charging current and, if necessary, of other electrical signals for controlling the charging process of the high-voltage battery.

The use of electrical connectors for transmitting a comparatively large amount of electrical drive energy (or also braking energy) in the case of electric and/or hybrid vehicles requires specifically designed electrical high-voltage connectors. It must also be taken into account that alternating currents and/or switching edges with high DC voltages generate electromagnetic interference signals that can interfere with the electronics in an electronic control system, for example within a motor vehicle. Efficient electromagnetic shielding, in particular of the electrical connectors used in the high-voltage range in motor vehicles, is therefore advantageous in order to avoid impairment of control devices within the vehicle. The shielding of the electrical connectors is therefore subject to correspondingly stringent requirements.

It is also to be noted that electrical plug-in connections for the automotive industry, or for vehicles, must be able to reliably withstand the—sometimes high—mechanical and electrical vibration loads that occur during vehicle operation.

The present invention is based on the object of improving the electrical connectors known from the prior art, in particular of increasing their tightness and vibration resistance.

The present invention is also based on the object of providing an electrical plug-in connection that is composed of a connector and a mating connector and that, in particular, has a high degree of tightness and vibration resistance.

The present invention is furthermore based on the object of creating a high-voltage system, in particular for a motor vehicle, that has an electrical connector which, in particular, has a high degree of tightness and vibration resistance.

The present invention is additionally based on the object of providing an advantageous method for locking an electrical plug-in connection composed of a connector and a mating connector, which in particular ensures a tight and vibration-proof locking of the plug-in connection.

The electrical connector, according to the invention, has a connector housing, a securing element, and an actuating element that is movable between a home position and a locking position and that is designed to lock the electrical connector to a corresponding electrical mating connector.

When the electrical connector is locked to the corresponding electrical mating connector, the connector and the mating connector are electrically and mechanically functionally connected for the intended use for power and/or signal transmission.

When the actuating element is in the home position, this is sometimes referred to in the following as the "open state" or "open actuating element". When the actuating element is in the locking position, this is also referred to in the following as the "closed state" or "closed actuating element".

According to the invention, the connector housing has a locking safeguard for guiding the securing element between an initial position and a securing position. It is provided that, in the securing position, the securing element is in engagement with the actuating element in such a manner that the actuating element is blocked in the locking position.

In particular, it may be provided that the securing element is in direct engagement with the actuating element in order to block the actuating element in the locking position. Preferably, the securing element does not thereby indirectly block the actuating element by the blocking of a primary latching connection between the actuating element and the connector housing. For example, it may be provided that the securing element engages in a recess or receiver of the actuating element that is independent of a primary latching connection, and/or engages behind a portion of the actuating element, or secures it directly by positive engagement in some other way.

According to the invention, it can thus be ensured that the electrical connector and the electrical mating connector are securely held in the locking position, since a movement of the actuating element from the locking position back into the home position is blocked. This principle is sometimes also referred to as "housing locking" or "connector position assurance" (CPA).

According to the invention, it is further provided that the securing element has at least one latching lug, and the locking safeguard has at least one first stop for the at least one latching lug, in order to block the securing element, at first in the initial position, in the direction of the securing position.

The term "at first" in the present case is intended to express that the securing element in the initial position is basically blocked in the direction of the securing position, as long as no further (mechanical) measures are implemented.

A latching lug may also be understood as a latching hook, and the latching hook may possibly have a latching lug.

According to the invention, it is provided for this purpose that the actuating element has at least one release body, which is designed to enter a recess in the locking safeguard and to displace the at least one latching lug of the securing element relative to the at least one first stop of the locking safeguard, in order to release the displacement path of the securing element, starting from the initial position, into the securing position.

Preferably, the actuating element and/or the release body are designed to displace the latching lug of the securing element while the release body enters the recess in the locking safeguard. Thus, while the release body thus enters the recess in the locking safeguard, the latching lug of the securing element can thus advantageously be lifted out of the recess, as a result of which the displacement path into the securing position can be released.

By use of the securing element, it can thus be ensured, on the one hand, that the electrical plug-in connection, composed of the electrical connector and the electrical mating connector, remains closed, or locked, even under adverse operating conditions.

Moreover, following manual (or other) assembly of the plug-in connection, or after the actuating element has been moved into the locking position, it can be ensured by means of the securing element that the connector and the mating connector are correctly locked, or latched. An incorrectly latched plug-in connection can be recognized, in particular, by the fact that the securing element cannot be brought into the securing position because it is not released by the correctly positioned actuating element.

Thus, according to the invention. (unintentional) impairment of the tightness and/or vibration resistance of the plug-in connection can be virtually precluded.

It is also a particular advantage of the invention that the release body of the actuating element releases the locking element inside the locking safeguard, or enters the recess in the locking safeguard in order to displace the latching lug accordingly. This enables the latching lug to be actuated in a defined and tolerance-insensitive manner.

The at least one release body may be, for example, at least one collar, at least one web and/or at least one pin that can suitably enter the recess of the locking safeguard in order to displace the at least one latching lug.

Owing to the high vibration resistance and tightness of the plug-in connection according to the invention, the plug-in connection is suitable for the transmission of electrical data signals with high priority and/or for the transmission of electrical supply signals with potential danger or with high safety requirements (e.g. in the case of a high-voltage connection). The plug-in connection according to the invention is therefore particularly suitable for use in a vehicle, in particular in a motor vehicle.

In one development of the invention, it may be provided that the at least one release body of the actuating element, for the purpose of releasing the displacement path of the securing element, is pressed against the at least one latching lug in order to displace the at least one latching lug relative to the at least one first stop of the locking safeguard, preferably while the release body enters the recess in the locking safeguard.

In particular, a direct actuation of the at least one latching lug by the release body through the recess in the locking safeguard can enable a particularly simple release of the locking safeguard. In this case, the at least one release body and the at least one latching lug are in direct contact with each other during the displacement.

In one development of the invention, it may also be provided that the locking safeguard realizes a loss prevention device for the securing element (preferably in the initial position of the securing element), and for this purpose preferably has at least one second stop.

In particular, it may be provided that, when the securing element is in the initial position, the at least one latching lug of the securing element is received between the at least one first stop and the at least one second stop.

The at least one second stop may be realized opposite the at least one first stop. This may be realized, for example, by at least one recess in the locking safeguard, the opposite edges, or side surfaces, of which form the stops.

Falling out or unauthorized removal of the securing element from the locking safeguard can thus be prevented, even when the securing element is in the initial position. The securing element can therefore be delivered, for example, together with the electrical connector already in the initial position, without risk of loss of the securing element during transport and/or storage of the connector.

It may be provided that the loss prevention device, or the at least one latching lug and/or the at least one second stop, are realized in such a manner that the securing element can—if desired—also be removed from the locking safeguard by the application of a defined amount of force, whereas accidental falling out is safely avoided.

Advantageously, the at least one latching lug can be used, on the one hand, to protect the securing element, in the initial position, against unintentional falling out, and on the other hand to block the displacement path of the securing element, starting from the initial position, into the securing position, as long as the actuating element is not in the locking position. This can be a particular advantage, as the formation of functionally different latching lugs on the securing element can be avoided. This can result in savings in material, as well as a reduction of the manufacturing resource requirement for the electrical connector.

In one development of the invention, it may also be provided that the locking safeguard has at least one third stop, which is designed to block the securing element in the securing position, in particular to block the displacement path of the securing element from the securing position back into the initial position.

Thus, for example, accidental, or unintentional, falling out or removal of the securing element can be avoided if the securing element is already in the securing position. This development can be advantageous because an unintentional removal of the securing element from the securing position could eventually result in the actuating element no longer being sufficiently secured and the electrical plug-in connection being unintentionally disconnected.

Thus, advantageously, the at least one latching lug can fulfill up to three functions. According to the invention, the at least one latching lug serves, firstly, to block the displacement path of the securing element, starting from the initial position, into the securing position. However, the at least one latching lug can additionally serve as a loss prevention device for the securing element, starting from the initial position, and/or as an additional securing entity for blocking the securing element in the securing position. The use of different latching lugs to fulfill the individual functions can thus be avoided.

Preferably, the locking safeguard comprises the at least one second stop and the at least one third stop.

In a development, it may be provided that the at least one latching lug has a bevel and/or chamfer on its side surface, or edge, that faces away from the at least one first stop of the locking safeguard when the securing element is in the initial position.

In particular, use of a beveled side surface, or a chamfer of an edge, allows a blocking of the displacement path of the securing element, initially caused by a stop, also to be released again, if necessary, by application of a correspondingly large amount of force. This can be advantageous, in particular, in order if necessary to release, or withdraw, the securing element, which is secured by means of a loss prevention device, from the locking safeguard again, and/or in order to return the securing element, starting from the securing position, into the initial position by use of a correspondingly defined amount of force, if desired. At the same time, accidental departure from the positions of the securing element or accidental falling out of the securing element can be avoided. In this way, if necessary, a reversible blocking of the securing element in the locking safeguard can be provided.

It may be provided that, in addition to, or as an alternative to a bevel and/or chamfer of the at least one latching lug, the at least one first stop, the at least one second stop and/or the at least one third stop have/has a bevel and/or chamfer.

In one design of the invention, it may be provided that the at least one latching lug is realized on a spring arm and/or on an at least partially elastic web, in order to provide the reversible locking described above.

In one further design of the invention, it may be provided that the securing element has an end stop that impinges on an end face of the locking safeguard when the securing element is in the securing position. This makes it easy for a fitter to see whether the plug-in connection is locked and secured.

In a development of the invention, it may be provided that the securing element has a closure tab, which is at least partially received in a corresponding receiver of the actuating element when the securing element is in the securing position.

It can thus be provided that the securing element, when in the securing position, with the closure tab is engaged with the corresponding receiver of the actuating element in such a manner that the actuating element is blocked in the locking position.

The closure tab may be a catch-type securing body. In particular, the closure tab may be of an elongate design, and protrude from the securing element in the direction of the actuating element when the securing element is in the locking safeguard.

The securing element may be inserted into the receiver of the actuating element in the manner of a catch, and thereby prevent movement of the actuating element, starting from the locking position, back into the home position.

Preferably, the closure tab blocks the actuating element in one degree of freedom, in particular substantially orthogonal to the direction of movement of the actuating element.

Advantageously, the closure tab may be realized without any locking mechanisms or latching lugs, in particular since a latching of the securing element in the securing position can be effected by the at least one latching lug in combination with, for example, the at least one third stop.

In one development, it may be provided that a rail guide is provided for the purpose of guiding the securing element in the locking safeguard, preferably in such a manner that the securing element has two guide webs that are guided in corresponding guide grooves of the locking safeguard.

Use of a rail guide enables, in particular, convenient displacement of the securing element and defined "threading" of the closure tab into the receiver of the actuating element.

In one development of the invention, in particular two latching lugs and two first stops for the two latching lugs, as well as two release bodies for displacing the latching lugs, may be provided.

Similarly, two second stops and/or two third stops may be provided for the two latching lugs.

In principle, any number of latching lugs, stops and release bodies may be provided, but they do not necessarily have to match. For example, only one latching lug, one first stop and one release body may be provided. Also, more than two latching lugs, stops and/or release bodies may be provided, for example three, four or more.

However, the use of two latching lugs, two first stops and two release bodies has proven to be particularly suitable as a simple way of providing a robust locking safeguard.

In one development, it may be provided that the closure tab extends between the two latching lugs.

In particular, a symmetrical design of the securing element can be advantageous in order to ensure convenient assembly of the connector, and in particular to avoid wedging of the securing element in the locking safeguard during insertion or displacement of the securing element from its initial position into the securing position. However, other geometries are also possible within the scope of the invention, in particular also the use of a single latching lug realized between two closure tabs, etc.

In one development of the invention, it may also be provided that the actuating element is realized as an actuating lever, and preferably realizes a link guide with at least one, preferably two, guide lug(s) of the electrical mating connector.

In particular, the use of an actuating lever has proven to be suitable. The actuating lever may be arranged, for example, on the side of the connector, preferably on both sides, and can be pivoted through a defined angular range during actuation from the home position into the locking position, for example through an angular range of up to 180 degrees, preferably through an angular range of approximately 90 degrees.

However, an actuating slide may also be provided.

Closing of the actuating lever, or actuation of the actuating lever from the home position into the locking position, enables the plug-in connection to be locked with a small amount of force.

It may be provided that the actuating element latches in the locking position with the connector housing by means of a primary latching connection, for example by the actuating element latching behind a latching lug of the connector housing.

It may be provided that the actuating element, in the locking position, bears against a housing part of the connector.

In principle, a plurality of actuating elements and/or a plurality of guide means may be provided.

The actuating element may have recesses in which the guide means (for example the guide lug) of the mating connector can be accommodated. In particular, the actuating lever or the actuating slide may be realized as a slotted link of a link guide, in which at least one link block of the mating connector is positively guided.

Preferably, the mating connector has two link blocks or guide lugs that protrude from the side of the mating connector, in particular orthogonally in relation to the plug-in direction.

The invention also relates to an electrical plug-in connection, comprising an electrical connector according to the above embodiments, and an electrical mating connector corresponding to the electrical connector, wherein the electrical mating connector has at least one guide means, which acts in combination with an actuating element of the electrical connector that is movable between a home position and a locking position, in such a manner that the plug-in connection, starting from a pre-latching position, assumes a locking position when the actuating element is moved from the home position into the locking position.

The electrical plug-in connection is designed, in particular, for power electronics in the automotive sector. However, the invention is not limited to this. In principle, the plug-in connection according to the invention can be advantageously used within the entire electrical engineering sector, or entire electronics sector.

The pre-latching position is preferably an initial position, starting from which the actuating element can be actuated by a user/fitter or an assembly device for the purpose of connecting the connector to the mating connector.

It may be provided that the connector and the mating connector are already mechanically connected to each other in the pre-latching position, for example are captively connected to each other and/or are in a state in which the electrical plug-in connection can be delivered safely for transport.

In one development, it may be provided that the electrical connector has a toothing and the electrical mating connector has a mating toothing corresponding to the toothing of the electrical connector, wherein the toothing and the mating toothing are in engagement with each other when the plug-in connection is in the locking position.

During the actuation of the actuating element from the home position into the locking position, the toothing thus engages the corresponding mating toothing. The teeth of the toothing are thus pushed axially into each other in the direction of insertion while the actuating element is being actuated.

The toothing improves, or optimizes, the vibration loads on the plug-in connection. The toothing can absorb mechanical forces in the radial direction as well as in the cable outlet direction, and thus hold the connector stationary relative to the mating connector.

In one design of the invention, it may be provided that the mating connector is realized as a device connector or pin header.

Preferably, the electrical mating connector is an electrical pin header. Electrical pin headers are known, inter alia, in the automotive sector.

In one design of the invention, it may also be provided that the connector is realized as a coupling or plug.

However, the type of connector, or mating connector, is not of importance according to the invention. In principle, any type of connectors and mating connectors that can be connected to each other may be provided.

The forming of a toothing of a coupler for connection to a mating toothing of a pin header can be suitable, in particular, for realizing a plug-in connection in the high-voltage range. Particularly preferably, the electrical plug-in connection may be realized as a two-pole flat-contact plug-in connection.

In one development of the invention, it may be provided that the mating connector has a connector body for receiving a contact means, and has a shielding, wherein the connector body is designed for insertion in an opening of a housing part of a housing of an electronics unit. The connector body may be of multipart design, and comprise at least an inner connector body and an outer connector body positioned on opposite sides of the housing part, wherein the inner connector body can be fixed, independently of the housing part, in the housing of the electronics unit, and wherein fastening means are provided in order to connect the connector bodies to each other in such a manner that the housing part is fixed between the connector bodies.

It may thus be provided that the inner connector body of the mating connector, in addition to being fixed to the housing part, is also fixed to at least one further portion of the housing.

The development described enables the connector body of the mating connector to be easily and reliably connected to the housing part of the housing of the electronics unit. A defined positioning of the electrical connector body is thus easily achieved, in such a manner that the electrical connector can be reliably and safely connected to the electrical mating connector.

The electronics unit may preferably be a high-voltage electronics unit, in particular a high-voltage battery.

The inner connector body of the mating connector may be fastened in the housing in any manner, preferably by means of a screw connection, or corresponding screw-on points.

It can be advantageous if the inner connector body of the mating connector is first fixed in the housing of the electronics unit, and then the housing part, which is preferably realized as a cover, is put on.

The inner connector body of the mating connector and the housing part provided with the opening may in this case be positioned in relation to each other in such a manner that the housing part, in particular realized as a cover, can be placed on the housing in a suitable manner such that the inner connector body of the mating connector projects outwards from an interior of the housing, through the opening of the housing part. The outer connector body of the mating connector may then be placed on the outer side of the housing part in such a manner that the inner connector body can be connected to the outer connector body with the aid of the fastening means, as a result of which the housing part, located between the two connector bodies, is also fixed.

The fastening means are preferably detachable.

Preferably, the fastening means are realized so as to be separate from the outer connector body of the mating connector. The outer connector body itself is therefore not a fastening means, in particular not a sleeve nut.

It may be provided that the fastening means are realized as screw connections.

In one design of the invention, it may be provided that the actuating element of the connector, in the home position, is in engagement with the guide means of the mating connector when the plug-in connection is in the pre-latching position.

It may be provided, for example, that the actuating lever of the connector has two side legs that are arranged laterally on the connector and are connected along the back of the connector via a web. The side legs of the actuating lever may have lateral recesses that, when the plug-in connection is in the pre-latching position, receive two guide lugs projecting from both sides of the outer connector body.

In one design of the invention, it may be provided that the toothing and/or the mating toothing are/is arranged around a central axis of the respective connector.

Such an arrangement is particularly suitable for absorbing radial forces by means of toothing, or mating toothing.

In one design, it may be provided that the toothing and/or mating toothing are/is arranged in the form of a partial ring or a ring around the central axis of the respective connector.

A toothing, or mating toothing, in the form of a partial ring has proven to be particularly suitable, as a sufficiently vibration-proof toothing can then be provided with a comparatively small resource requirement, e.g. resource requirement in respect of material and production.

In the case of the toothing in the form of a partial ring, the toothing and the mating toothing may each be realized at least along a circumferential portion of 10 degrees, preferably of 30 degrees, particularly preferably of 60 degrees, and very particularly preferably of 120 degrees, for example also 150 degrees, 180 degrees, 210 degrees, 240 degrees, 270 degrees, 300 degrees, 330 degrees, up to 360 degrees.

In one design of the invention, it may be provided that the toothing and the mating toothing, when they are in engagement with each other, are in positive and/or non-positive engagement, preferably elastically pressed into each other.

In particular, elastic pressing when the plug-in connection are being plugged together by actuation of the actuating element has proven to be particularly suitable for providing a high level of vibration resistance of the connected plug-in connection. Owing to the fact that an actuating element is used to connect the plug-in connection, a user or an assembly device can apply a sufficiently high force, for example by use of a physical lever arm, to press the toothings against each other.

In one design, it may further be provided that the teeth of the toothing and/or of the mating toothing taper outwards, the teeth of the toothing and the teeth of the mating toothing preferably differing from each other in their pitch.

In particular, if the teeth of the toothing and the teeth of the mating toothing differ in their pitch, the toothing can be compressed particularly well in the locking position of the plug-in connection, while at the same time the teeth can be easily "threaded" into each other. In this case, the plug-in connection can have a high vibration resistance and holding force virtually irrespective of the manufacturing tolerances.

It may further be provided that the shielding of the mating connector has a cylindrical portion and a plurality of shielding tabs adjoining the cylindrical portion.

The shielding tabs of the mating connector may have radially projecting contact points that are positioned in such a manner that the contact points contact the housing part in the region of the opening.

It may further be provided that the shielding of the mating connector is connected to the connector body of the mating connector.

Finally, it may be provided that the contact means of the mating connector is accommodated in the inner connector body, preferably positively connected, and in particular clipped, to the inner connector body.

Furthermore, it may be provided that the contact means of the mating connector has at least one, preferably two, four or more inner conductor parts, which are preferably realized as pin contacts and/or male contacts. The connector can be realized so as to correspond thereto.

The plug-in connection can be particularly suitable for transmitting electrical current, e.g. for charging a battery. For this purpose, it may be provided that the inner conductor parts of the connector and mating connector are used for electric power supply. It may be provided, in the case of a design with two inner conductor parts, that one inner conductor part is connected to the electrical negative pole, or ground, and the other inner conductor part is connected to an electrical positive pole of the supply voltage. In the case of a design with four inner conductor parts, it may preferably be provided that the inner conductor parts are each positioned in pairs in such a manner that one pair of inner conductor parts is connected to the electrical negative pole, and one pair of inner conductor parts is connected to the electrical positive pole of the supply voltage, in such a manner that in each case one inner conductor part of a corresponding mating connector can be inserted, respectively, between one pair of inner conductor parts of the electrical connector. A particularly reliable transmission of the currents can thereby be achieved.

It may further be provided that the connector bodies of the mating connector have a positioning means, such that the connector bodies of the mating connector can only be connected to each other in a defined orientation.

Furthermore, it may be provided that the connector realizes a coding means with the mating connector, in such a manner that the connector and the mating connector can only be connected to each other in a defined orientation.

In one design of the invention, it may be provided that the mating connector has a guide realized in the form of a partial ring, which is designed to enable the mating connector to be connected to the connector. Preferably, the connector may have a 45 degree outlet to 135 degree outlet, more preferably a 90 degree outlet.

Reliable and robust contacting of the electrical connector to the mating connector is particularly important for plug-in connections used in power electronics in the automotive sector. The design of a guide, in particular a guide ring on the electrical mating connector, has proven to be particularly suitable for reliably connecting the electrical connector.

The guide may preferably be realized on the outer connector body of the mating connector. Insofar as the connector has an outlet that is parallel to the longitudinal axis of the electrical mating connector, or that extends in the plug-in direction, the electrical mating connector can also have a closed, ring-shaped guide.

In one design, it may be provided that the mating toothing of the mating connector is arranged in the form of a partial ring and opposite the partially ring-shaped guide with respect to a central axis of the mating connector, the mating toothing preferably being oriented in the direction of the outlet of the connector when the plug-in connection is closed.

A particularly stable and vibration-proof plug-in connection and thereby be achieved.

The invention also relates to a mating connector, in particular a device plug or an electrical pin header for automotive power electronics, for use in an electrical plug-in connection according to the above embodiments.

It is to be noted that features relating to the mating connector can also be advantageously implemented for the connector—and vice versa. This applies, in particular, to a two-part, or multipart, construction, the shielding, the contact means, the toothing/mating toothing, the locking safeguard and the design of the housing part and the connector body, or bodies.

The invention additionally relates to a high-voltage system, in particular for a motor vehicle, comprising an electrical connector as disclosed herein, and a housing of a high-voltage electronics unit, in particular a high-voltage battery, having a housing part to which a mating connector can be fixed for the purpose of connecting to the connector.

The invention additionally relates to a high-voltage system, in particular for a motor vehicle, comprising an electrical plug-in connection as disclosed herein, and a housing of a high-voltage electronic unit, in particular a high-voltage battery, having a housing part to which a mating connector can be fixed for connection to the connector.

Furthermore, the invention relates to a high-voltage cable set, having an electrical connector as disclosed herein, and having an assembled cable with a corresponding electrical mating connector.

The electrical plug-in connection can advantageously be used for the transmission of high data volumes, for example from various optical cameras, sensors or navigation sources, in real time. Possible fields of application are, in particular, autonomous driving, driver assistance systems, navigation, infotainment, Internet and mobile communication. The invention is particularly suitable, however, for use in high-voltage technology and, in particular, for transmitting motor and/or charging power for hybrid and electric motors. The invention may be suitable for use with voltages of up to 1.000 volts at continuous currents of up to 450 amperes or more.

The invention furthermore relates to a method for locking an electrical plug-in connection composed of a connector and a mating connector, according to which the plug-in connection, starting from a pre-latching position, is brought into a locking position in that an actuating element of the connector is moved from a home position into a locking position, wherein the actuating element of the connector accordingly acts in combination with a guide means of the mating connector. It is provided that at least one release body of the actuating element enters a recess of a locking safeguard of the connector and displaces at least one latching lug of a securing element relative to at least one first stop of the locking safeguard, in order to release the displacement path of the securing element, starting from an initial position, into a securing position when the actuating element is in the locking position. The securing element, after its release, is moved from the initial position into the securing position and brought into engagement with the actuating element in such a manner that the actuating element is blocked in the locking position.

In the case of closing the actuating element, in particular an actuating lever, it may be provided, for example, that the actuating element enters the recess of the locking safeguard of the connector housing via an actuating collar. The actuating collar may then press against the at least one latching lug of the securing element in order to release the securing element, which at this point in time is still blocked, as soon as the actuating lever is in the locking position. The securing element is thus released when the actuating element is in the locking position, and can be pushed forward in the direction of the actuating element. The securing element in this case can enter a provided recess, or opening of the actuating lever, and can thus prevent the actuating lever from opening again.

The method makes it particularly easy to close and lock the electrical plug-in connection. Furthermore, a robust, in particular vibration-proof, tight and reliable connection is created between the connector and the mating connector.

With regard to the locking process of the plug-in connection, in particular the following sequence may result: first, the securing element may be fixed in the initial position, after which the actuating element releases the securing element, after which the securing element is displaced into the securing position and thereby locks the actuating element by the closure tab, after which preferably the at least one latching lug, particularly preferably two latching lugs, hook behind the at least one third stop when the securing element is in the securing position, in such a manner that the securing element cannot be pushed back into the initial position at least without a defined application of force.

Features that have already been described in connection with the connector may, of course, also be advantageously implemented for the plug-in connection, the mating connector, the high-voltage system, the high-voltage cable set and the method according to the invention—and vice versa. Furthermore, advantages already mentioned in connection with the electrical connector may also be understood in relation to the plug-in connection, the mating connector, the high-voltage system, the high-voltage cable set and the method according to the invention—and vice versa.

In addition, it should be noted that terms such as "comprising", "having" or "with" do not exclude other features or steps. Moreover, terms such as "a" or "the" that indicate a single number of steps or features, do not exclude a plurality of features or steps—and vice versa.

Exemplary embodiments of the invention are described in greater detail in the following, on the basis of the drawings.

The figures show preferred exemplary embodiments in which individual features of the present invention are shown in combination with each other. However, the features of an exemplary embodiment can also be implemented separately from the other features of the same exemplary embodiment, and can therefore be easily combined by a person skilled in the art to form further useful combinations and sub-combinations.

SUMMARY

A principal aspect of the present invention is an electrical connector, having a connector housing, a securing element, and an actuating element that is movable between a home position ($P_0$) and a locking position ($P_1$) that and is designed to lock the electrical connector to a corresponding electrical mating connector, wherein the connector housing has a locking safeguard for guiding the securing element between an initial position ($S_0$) and a securing position ($S_1$), and wherein, in the securing position ($S_1$), the securing element is in engagement with the actuating element in such a manner that the actuating element is blocked in the locking position ($P_1$), and wherein the securing element has at least one latching lug and the locking safeguard has at least one first stop for the at least one latching lug, in order to block the securing element, at first in the initial position ($S_0$), in the direction of the securing position ($S_1$), and wherein the actuating element has at least one release body, which is designed to enter a recess in the locking safeguard and to displace the at least one latching lug of the securing element relative to the at least one first stop of the locking safeguard, in order to release the displacement path of the securing element, starting from the initial position ($S_0$), into to the securing position ($S_1$).

A further aspect of the present invention is an electrical connector, characterized in that the at least one release body of the actuating element, for the purpose of releasing the displacement path of the securing element, is pressed against the at least one latching lug in order to displace the at least one latching lug relative to the at least one first stop of the locking safeguard.

A further aspect of the present invention is an electrical connector, characterized in that the locking safeguard realizes a loss prevention device for the securing element, and for this purpose preferably has at least one second stop.

A further aspect of the present invention is an electrical connector, characterized in that the locking safeguard has at least one third stop, which is designed to block the securing element in the securing position ($S_1$), in particular to block the displacement path of the securing element from the securing position ($S_1$) back to the initial position ($S_0$).

A further aspect of the present invention is an electrical connector, characterized in that the at least one latching lug has a bevel and/or chamfer on its side surface that faces away from the at least one first stop of the locking safeguard when the securing element is in the initial position ($S_0$).

A further aspect of the present invention is an electrical connector, characterized in that the securing element has a closure tab, which is at least partially received in a corresponding receiver of the actuating element when the securing element is in the securing position ($P_1$).

A further aspect of the present invention is an electrical connector, characterized in that a rail guide is provided for the purpose of guiding the securing element in the locking safeguard, preferably in such a manner that the securing element has two guide webs that are guided in corresponding guide grooves of the locking safeguard.

A further aspect of the present invention is an electrical connector, characterized in that two latching lugs and two first stops for the two latching lugs, as well as two release bodies for displacing the latching lugs, are provided.

A further aspect of the present invention is an electrical connector, characterized in that the closure tab extends between the two latching lugs.

A further aspect of the present invention is an electrical connector, characterized in that the actuating element is realized as an actuating lever, and preferably realizes a link guide with at least one guide lug of the electrical mating connector.

A further aspect of the present invention is an electrical plug-in connection, comprising an electrical connector, and an electrical mating connector corresponding to the electrical connector, wherein the electrical mating connector has at least one guide means, which acts in combination with an actuating element of the electrical connector that is movable between a home position ($P_0$) and a locking position ($P_1$), in such a manner that the plug-in connection, starting from a pre-latching position, assumes a locking position when the actuating element is moved from the home position ($P_0$) into the locking position ($P_1$).

A further aspect of the present invention is an electrical plug-in connection, characterized in that the electrical connector has a toothing and the electrical mating connector has a mating toothing corresponding to the toothing of the electrical connector, wherein the toothing and the mating toothing are in engagement with each other when the plug-in connection is in the locking position.

A further aspect of the present invention is an electrical plug-in connection, characterized in that the mating connector has a connector body for receiving a contact means, and has a shielding, wherein the connector body is designed for insertion into an opening of a housing part of a housing of an electronics unit, and wherein the connector body is of a multipart design, and comprises at least one inner connector body and one outer connector body positioned on opposite sides of the housing part, wherein the inner connector body can be fixed, independently of the housing part, in the housing of the electronics unit, and wherein fastening means are provided in order to connect the connector bodies to each another in such a manner that the housing part is fixed between the connector bodies.

A still further aspect of the present invention is a high-voltage system, in particular for a motor vehicle, having an electrical connector, and a housing of a high-voltage electronic unit, in particular a high-voltage battery, having a housing part to which a mating connector is fixed for connection to the connector.

An even still further aspect of the present invention is an method for locking an electrical plug-in connection composed of a connector and a mating connector, according to which the plug-in connection, starting from a pre-latching position, is brought into a locking position in that an actuating element of the connector (2) is moved from a home position ($P_0$) into a locking position ($P_1$), wherein the actuating element of the connector accordingly acts in combination with a guide means of the mating connector, and wherein at least one release body of the actuating element enters a recess of a locking safeguard of the connector and displaces at least one latching lug of a securing element relative to at least one first stop of the locking safeguard, in order to release the displacement path of the securing element, starting from an initial position ($S_0$), into a securing position ($S_1$) when the actuating element is in the locking position ($P_1$), and wherein the securing element, after its release, is moved from the initial position ($S_0$) into the securing position ($S_1$) and brought into engagement with the actuating element in such a manner that the actuating element is blocked in the locking position ($P_1$).

These and other aspects of the invention are more fully disclosed herein.

BRIEF DESCRIPTIONS OF THE DRAWINGS

In the figures, elements that are functionally identical are denoted by the same references.

DETAILED WRITTEN DESCRIPTION OF THE PREFERRED EMBODIMENTS

This disclosure of the invention is submitted in furtherance of the Constitutional purposes of the U.S. Patent laws "to promote the progress of science and useful arts." (Article 1, Section 8).

Figure 1:
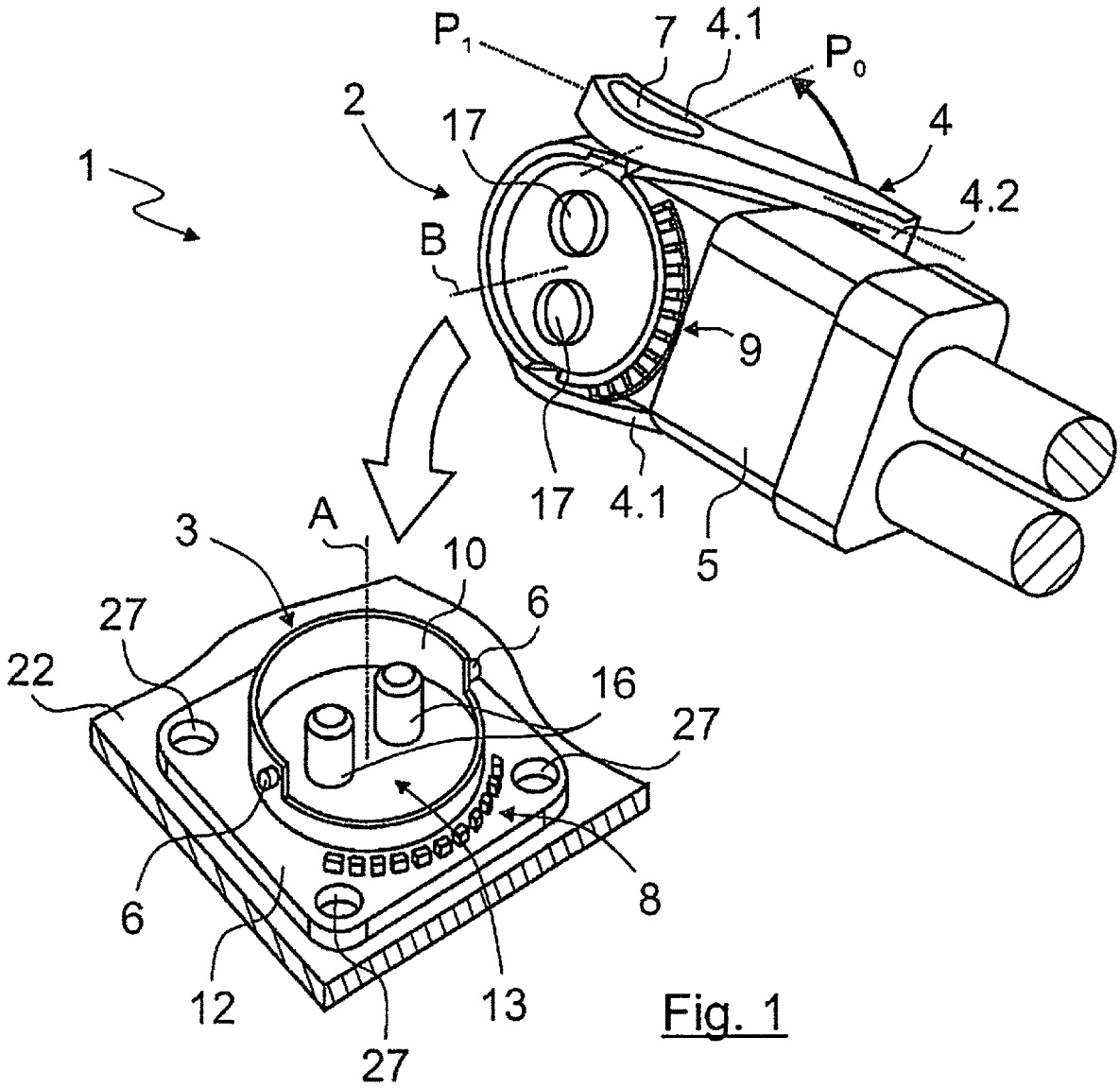
FIG. 1 is an electrical plug-in connection, comprising a connector and a mating connector, in a perspective representation.

FIG. 1 shows a simplified embodiment of the electrical plug-in connection 1, comprising a connector 2 and a mating connector 3 that can be connected to the connector 2. In the exemplary embodiment the connector 2 is realized as a coupling, and the mating connector 3 as a pin header. However, the type of connector 2, or mating connector 3, is not important in the context of the invention.

To aid illustration, FIG. 1 shows a state of the plug-in connection 1 in which the connector 2 and the mating connector 3 are not mechanically connected and are not yet in a pre-latching position.

Figure 8:
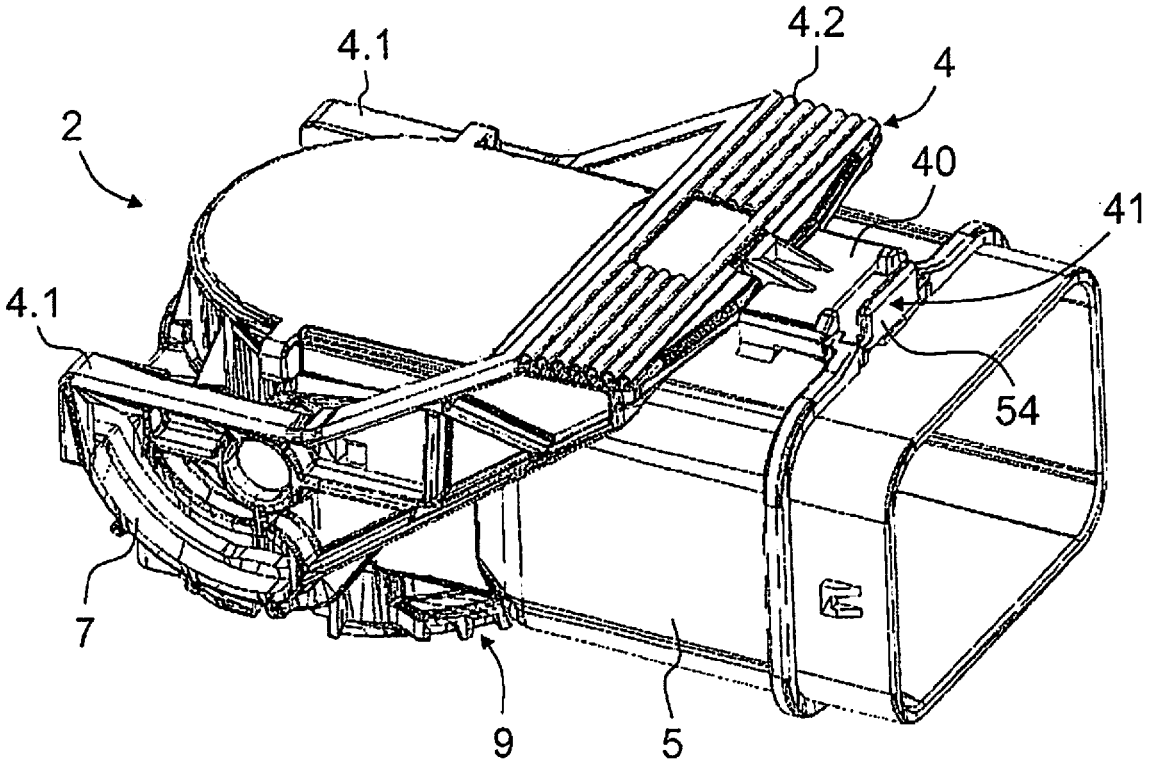
FIG. 8 shows the connector of FIG. 3 inverted, with the actuating element and the locking safeguard, in a further perspective view.
Figure 11:
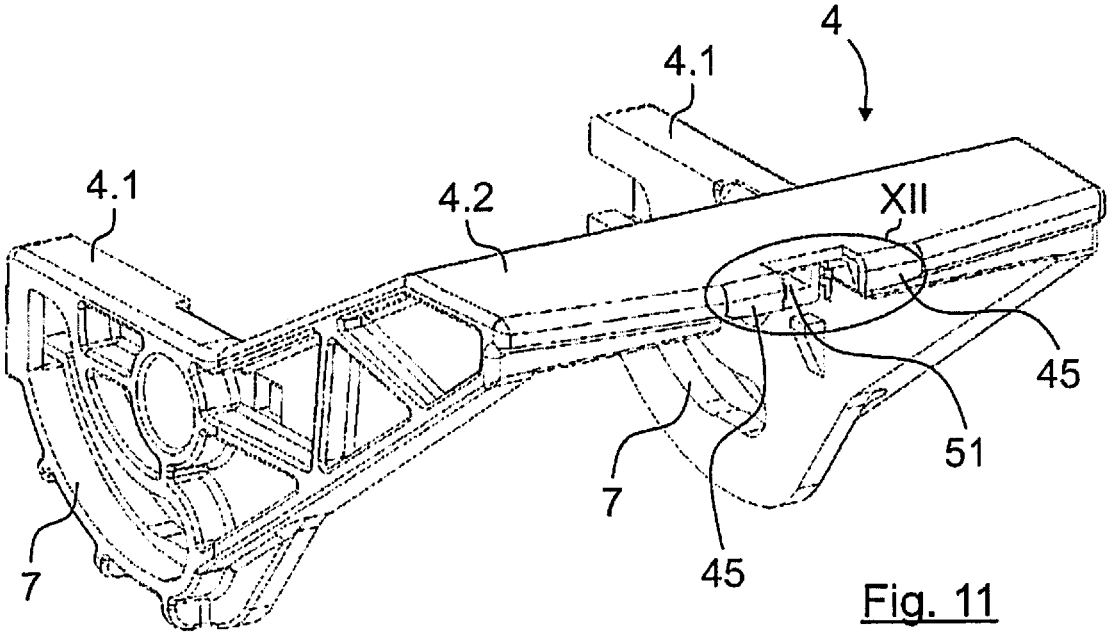
FIG. 11 is an enlarged perspective detail representation of an actuating lever of the connector.

The connector 2 has an actuating element 4 that can move between a home position $P_0$ and a locking position $P_1$, and which in the exemplary embodiment is realized as an actuating lever 4. In the exemplary embodiment the actuating lever 4 has two side legs 4.1 that are connected to each other via a web 4.2 (c.f. FIGS. 1, 8 and 11). In principle, however, the actuating element may also be realized differently, for example as an actuating slide.

In the unconnected state of the plug-in connection 1 of FIG. 1, the actuating lever 4 is in the locking position $P_1$ to save space, and bears against the connector housing 5 of the connector 2. Before the plug-in connection 1 is mechanically connected, it is therefore necessary to move the actuating lever 4 into the home position $P_0$.

The actuating element 4, or the actuating lever 4, is designed to act in combination with a guide means 6 of the mating connector 3 in such a manner that the plug-in connection 1 assumes a locking position (cf. FIG. 6), starting from a pre-latching position (cf. FIG. 5), when the actuating element 4, or the actuating lever 4, is moved from the home position $P_0$ into the locking position $P_1$. In the exemplary embodiment the guide means 6 is realized as two guide lugs 6 that protrude laterally from the mating connector 3. To receive the guide lugs 6, the side legs 4.1 of the actuating lever 4 each define lateral recesses 7. In the exemplary embodiment the guide lugs 6 realize the link blocks of a link guide formed in combination with the actuating lever 4.

The connector 2 has a toothing 9, and the mating connector 3 has a mating toothing 8, corresponding to the toothing 9 of the connector 2. The toothing 9 and the mating toothing 8 are in engagement with each other when the plug-in connection 1 is in the locking position (cf. FIG. 6).

The toothing 9 and the mating toothing 8 are each arranged around a central axis A, B of the corresponding connector 2, 3. It has proven advantageous in this case to arrange the toothing 9 and the mating toothing 8 in each case only in the form of a partial ring around the central axis A, B of the respective connector 2, 3, as this allows a simplified structure of the electrical plug-in connection 1, while still ensuring a high level of vibration resistance. Clearly, however, a complete ring-shaped, or closed, arrangement of the toothing 9 and/or the mating toothing 8 is also possible.

Also provided in the exemplary embodiment is guide 10 of the mating connector 3 that is realized in the form of a partial ring, and that is designed to enable connection of the mating connector 3 to the connector 2, which in the exemplary embodiment has/defines a 90 degree outlet. In this case, the mating toothing 8 of the mating connector 3 is arranged opposite the partially ring-shaped guide 10 with respect to the central axis A of the mating connector 3, and faces in the direction of the outlet of the connector 2 when the plug-in connection 1 is closed.

Figure 2:
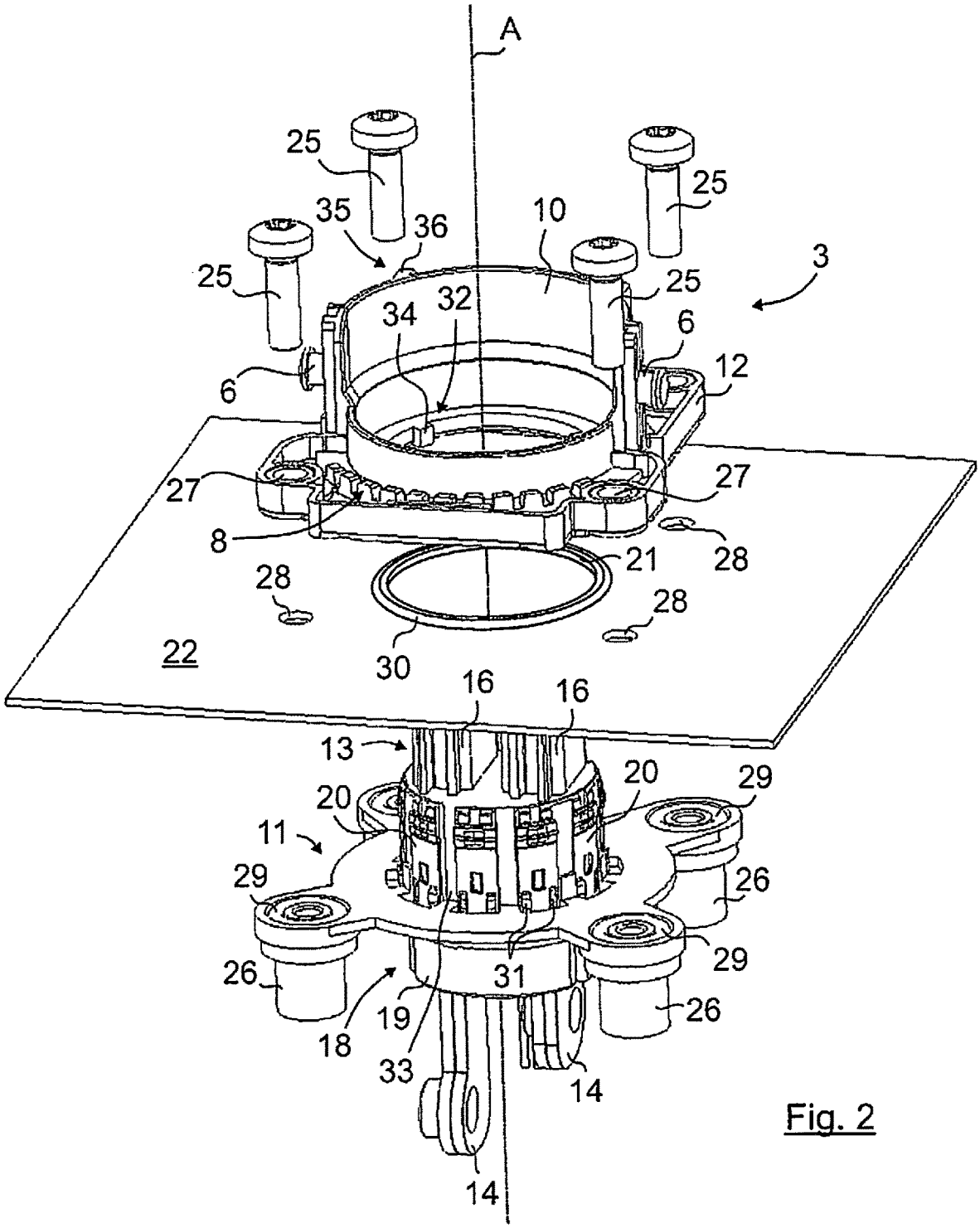
FIG. 2 is an exploded perspective view of an embodiment of the electrical mating connector, having an inner connector body, a housing part and an outer connector body.

FIG. 2 shows, in a more detailed representation, a further design of a mating connector 3 realized as a pin header. The mating connector 3 of FIG. 2 is suitable, in particular, for connection to the further connector 2 represented in FIG. 3, the features of which correspond substantially to those of the connector 2 of FIG. 1, for which reason no further description is provided for the same.

The electrical connector 2 and the electrical mating connector 3 are suitable, in particular, for use in power electronics in the automotive or electronics sector.

In the exemplary embodiment the electrical plug-in connection 1 is realized as a plug-in connection 1 for the high-voltage range, preferably as a component part of a high-voltage cable set, and this in turn preferably as a component part of a high-voltage system. However, the exemplary embodiment should not be understood as being limited to this.

The electrical mating connector 3 has a multipart connector body, which in the exemplary embodiment is composed of an inner connector body 11 and an outer connector body 12. The inner connector body 11 is not represented in FIGS. 1, 5 and 6.

As can be seen from FIG. 2, the inner connector body 11 accommodates a contact means 13. The contact means 13 may be connected to the inner connector body 11 in any manner. In the exemplary embodiment it is provided that the contact means 13 is inserted into the inner connector body 11 and is preferably hooked-in, or clipped-in, there with positive engagement.

Figure 7:
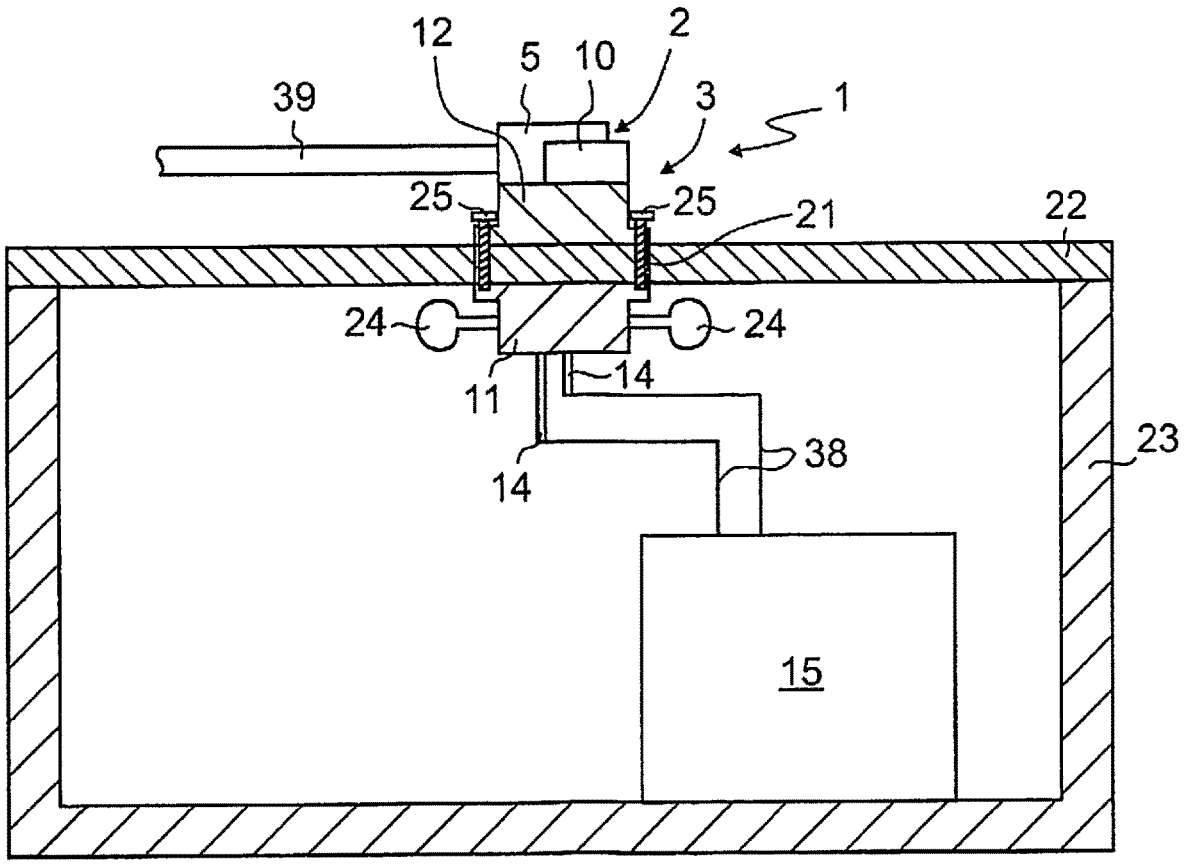
FIG. 7 is a general representation of a high-voltage system housing of a high-voltage electronics unit, in particular a high-voltage battery and a high-voltage cable set, comprising an electrical mating connector and an assembled cable having a corresponding connector.

In the exemplary embodiment electric power connections 14 are provided in the form of terminal lugs to enable contacting of the contact means 13, for example to an electronics unit 15 (c.f. FIG. 7) described below.

In the exemplary embodiment the electric power connections 14 are connected to inner conductor parts 16, which are designed to transmit electrical current to correspondingly realized inner conductor parts 17 (c.f. FIG. 1) of the connector 2.

Any number of inner conductor parts 16, 17 and any geometries of the inner conductor parts 16, 17 may be provided.

The contact means 13 may be designed to transmit electrical currents and/or data at any frequency and/or data rate. In the exemplary embodiment it is provided that the contact means 13 is suitable for the high voltage range for use with high voltages, in particular 220 volts and greater, preferably 400 to 1000 volts.

In the exemplary embodiment the contact means 13 has a circular outer circumference. However, the contact means 13 can have any shape, for example, but not limited to, a square or rectangular. However, a circular outer circumference, in particular also a concentric, or symmetrical, structure of the contact means 13 has proven to be suitable.

The inner conductor parts 16 of the contact means 13 may be realized in the form of plates (as represented in FIG. 2), or also realized as pin contacts and/or male contacts (as shown in FIG. 1). Other designs are also possible within the scope of the invention.

The inner connector body 11 has an electromagnetic shielding 18. Electromagnetic interference signals can be generated, in particular by alternating currents and/or switching operations of a DC voltage, which can interfere with the electronics, e.g. in a motor vehicle, in particular the electronic controllers there, such as an engine controller. The exemplary embodiment shows a particularly suitable embodiment of the shielding 18. The shielding 18 has a cylindrical portion 19 and a plurality of shielding tabs 20 adjoining the cylindrical portion 19. The connector 2 is preferably realized in such a manner that it also has a shielding (not represented) that at least partially contacts the shielding tabs 20 radially. The shielding tabs 20 are preferably resilient, in order to establish a good connection to the shielding of the connector 2.

In the exemplary embodiment, the shielding 18 is connected to the inner connector body 11. The inner connector body 11 and the shielding 18 are inserted together into an opening 21 defined in a housing part 22 of a housing 23.

The housing 23 may accommodate an electronics unit 15 (c.f. FIG. 7). In the exemplary embodiment the electronics unit 15 is preferably realized as a high-voltage electronics unit, in particular as a high-voltage battery 15.

A particularly advantageous connection of the inner connector body 11 with the housing 23, or the housing part 22, is achieved in that the inner connector body 11 is first fixed in the housing 23. Fixing may be effected in any manner. In the exemplary embodiment it is represented in general in FIG. 7 that the inner connector body 11 is fixed at screw-on points 24. The inner connector body 11 may be realized accordingly for this purpose (not represented in greater detail). It is advantageous if the inner connector body 11 is first fixed in the housing 23, and then the housing part 22 provided with the opening 21 is fitted, or the inner connector body 11 is inserted into the opening 21. For this purpose, the inner connector body 11 is fixed at a correspondingly suitable position in the housing 23, such that the opening 21 and the contact means 13 inserted into the inner connector body 11 are in concentric alignment with each other, such that the contact means 13 can enter the opening 21 outwardly from an interior of the housing 23.

In the exemplary embodiment it is provided that the housing part 22 is realized as a cover of the housing 23.

When the inner connector body 11 has been inserted through the opening 21, the outer connector body 12 is then attached to an outer side of the housing part 22. This is shown in the exploded view of FIG. 2. The outer connector body 12 and the inner connector body 11 are fixed by fastening means 25 in such a manner that the housing part 22 is also fixed between the connector bodies 11, 12. In the exemplary embodiment the fastening means are realized as screw connections, in particular as threaded screws 25.

In the exemplary embodiment it is further provided that the inner connector body 11 has at least two, and in the exemplary embodiment four, bushings 26 arranged symmetrically around a central axis A of the mating connector 3. In the exemplary embodiment the bushings 26 are realized as threaded bushings 26. The outer connector body 12 correspondingly has at least two through-holes 27, and in the exemplary embodiment four, arranged symmetrically around the central axis A of the mating connector 3.

In the exemplary embodiment it is provided that the housing part 22 has borings 28 that are in alignment with the threaded bushings 26, or the through-holes 27.

Also provided in the exemplary embodiment are seals, in the form of O-rings 29, to seal off the borings 28 in the housing part 22. In the exemplary embodiment it is provided that the O-rings 29 are inserted into the threaded bushings 26. Preferably, the threaded bushings 26 have corresponding recesses for this purpose.

Similarly, a seal 30 is likewise provided to seal off the opening 21. Used for this purpose in the exemplary embodiment is a sealing ring 30, which is positioned between the outer side of the housing part 22 and the outer connector body 12, and which extends around the opening 21 (represented only in FIG. 2).

As can be seen from FIG. 2, the shielding tabs 20 and/or alternatively (but not represented) the cylindrical portion 19 of the shielding 18 have/has contact points 31, which are positioned in such a manner that the contact points 31 contact the housing part 22 in the region of the opening 21. Preferably, for this purpose the contact points 31 project radially beyond the shielding tabs 20. The contact points 31 establish a reliable electrical connection between the shielding 18 and the housing part 22, which is preferably realized so as to be electrically conductive, in particular as a sheet metal part, or also as a casting.

As can be seen from FIG. 2, the connector bodies 11, 12 have a positioning means 32, in such a manner that the connector bodies 11, 12 can only be connected to each other in a defined orientation. In the exemplary embodiment it is provided that the positioning means 32 has at least one, and in the exemplary embodiment several, preferably three to four, positioning grooves 33, and positioning lugs 34 corresponding thereto.

In the exemplary embodiment the positioning grooves 33 are realized on the inner connector body 11, and extend in the axial direction between two spacedly adjacent shielding tabs 20. The outer connector body 12 has corresponding positioning lugs 34, which, when the outer connector body 12 has been correctly attached to the inner connector body 11, are inserted into the corresponding positioning grooves 33 extending in the axial direction A. In the exemplary embodiment it is provided that the connector bodies 11, 12 can only be connected to each other in exactly one orientation.

In the exemplary embodiment it is provided that the electrical connector 2 realizes a coding means 35 (c.f. FIG. 2) with the electrical mating connector 3, in such a manner that the connector 2 and the mating connector 3 can only be connected to each other in a defined orientation. In the exemplary embodiment it is provided that the electrical connector 2 and the electrical mating connector 3 can only be connected to each other in exactly one orientation.

Figure 3:
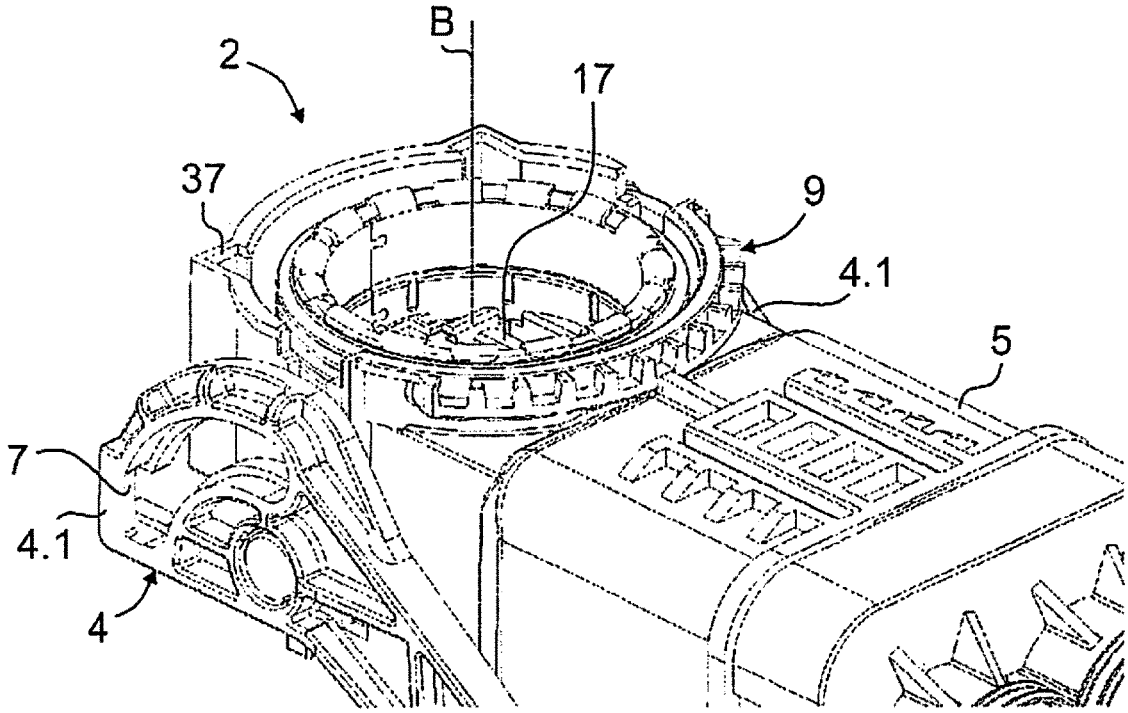
FIG. 3 is an embodiment of an electrical connector corresponding to the mating connector of FIG. 2, in a perspective representation.

A coding element 36 of the coding means 35 assigned to the outer connector body 12 is represented in FIG. 2, and a corresponding counterpart coding element 37, for receiving the coding element 36, is represented in FIG. 3. Such mechanical codings, for connecting electrical connectors 2 and electrical mating connectors 3 to each other, are known in principle from the prior art.

Figure 4:
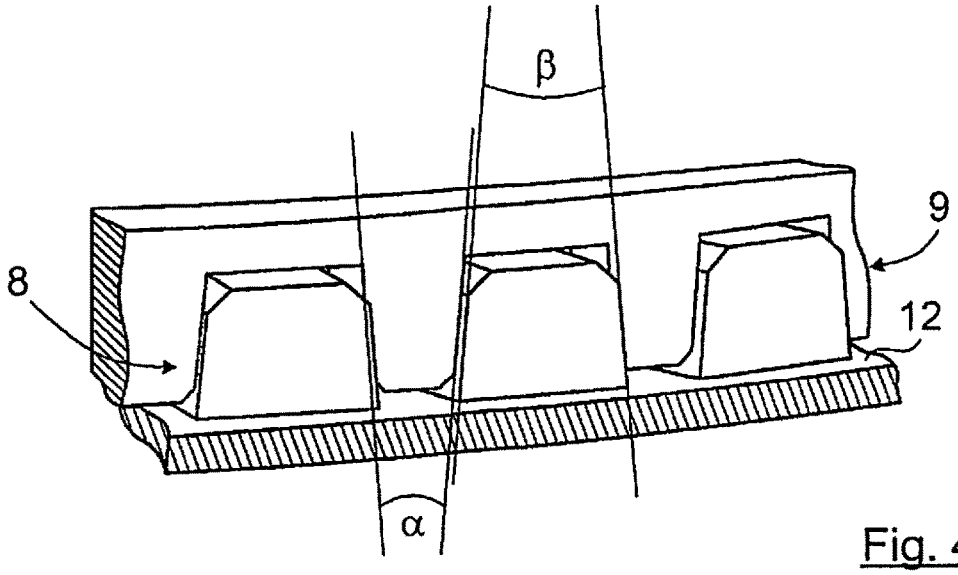
FIG. 4 is an enlarged perspective detail view of a toothing of the connector, which is pressed together with a mating toothing of the mating connector.

FIG. 4 shows the toothing 9 and the mating toothing 8 in engagement with each other when the plug-in connection 1 is in the locking position. It may be provided in this case, as represented in the exemplary embodiment, that the toothing 9 and the mating toothing 8 are in positive and non-positive engagement, preferably elastically pressed into each other. It may be advantageous for this purpose if the teeth of the toothing 9 and the teeth of the mating toothing 8 taper outwards, the teeth of the toothing 9 and the teeth of the mating toothing 8 preferably differing in their pitch (different angles $\alpha$ and $\theta$), which can advantageously enable pressing together.

For better insertion of the toothing 9 into the mating toothing 8, the individual teeth of the toothing 9 and/or of the mating toothing 8 may have bevels or chamfers, as represented in FIG. 4.

Figure 5:
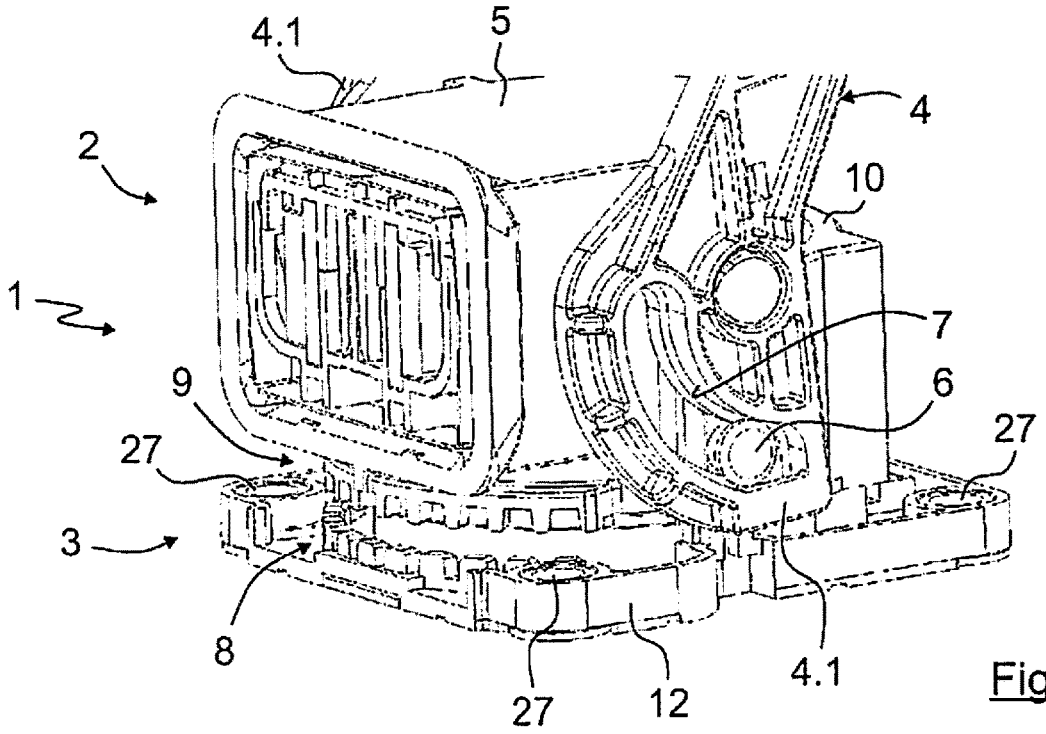
FIG. 5 shows the connector of FIG. 3 and the mating connector of FIG. 2, both in a perspective representation, in a pre-latching position.
Figure 6:
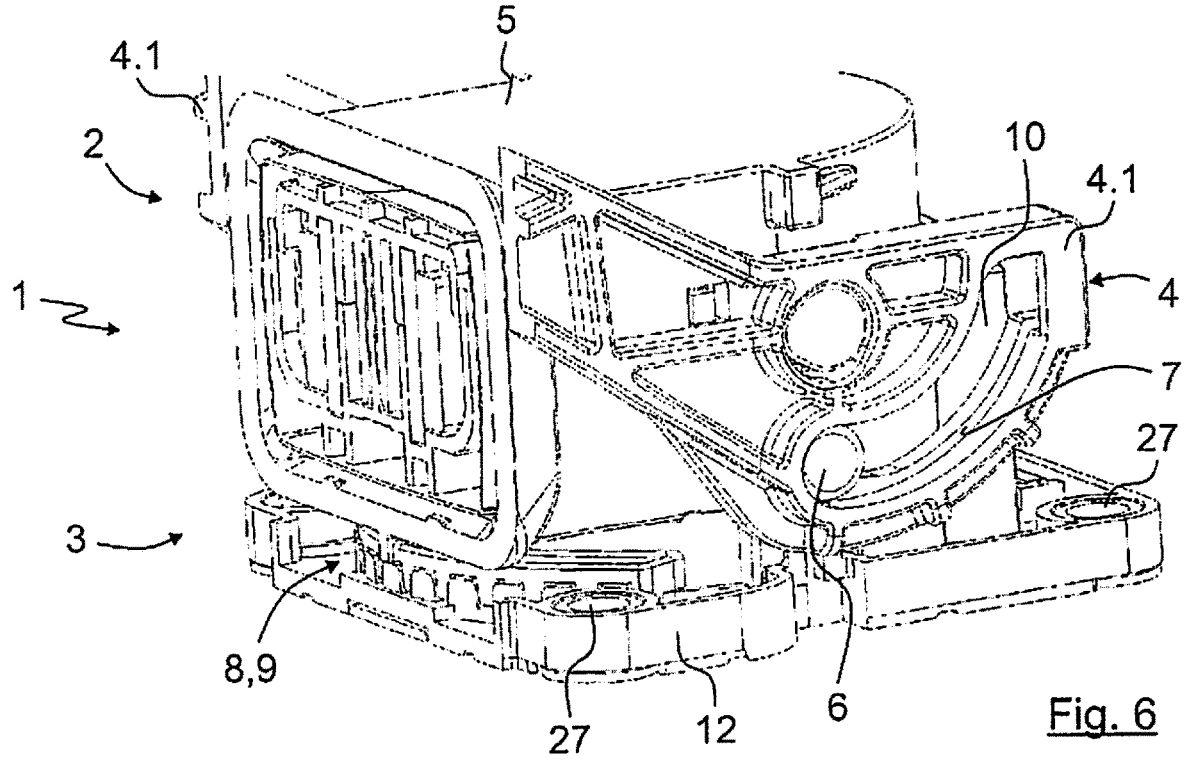
FIG. 6 shows the connector of FIG. 3 and the mating connector of FIG. 2, both in a perspective representation, in a locking position.

FIG. 5 shows the electrical plug-in connection 1 in a perspective, partially sectional view in the pre-latching position. FIG. 6 shows the electrical plug-in connection 1 in the locking position. It can be seen that the actuating element 4, or the actuating lever 4, of the connector 2, in the home position $P_0$, is in engagement with the guide means 6, or with the two guide lugs 6, of the mating connector 3 when the plug-in connection 1 is in the pre-latching position. Upon the actuating lever 4 being actuated from the home position $P_0$ (FIG. 5) into the locking position $P_1$ (FIG. 6), the electrical plug-in connection 1 can be reliably and easily closed by means of the constrained guidance, or link guide, provided as a result. Owing to the physical lever arm, a strong compression of the toothing 9 in the mating toothing 8 can be achieved with the application of comparatively little force.

The invention also relates to a high-voltage system, in particular for a motor vehicle, comprising an electrical plug-in connection 1 according to the above embodiments. In particular, as represented in FIG. 7, a housing 23 of a high-voltage unit, in particular a high-voltage battery 15, may be provided with a housing part 22, to which the mating connector 3 is fixed, and with a connector 2 for connection to the mating connector 3.

FIG. 7 shows a basic structure of a high-voltage system comprising the electrical connector 2 and the electrical mating connector 3. Also represented is the housing 23 that accommodates the electronics unit 15, which is preferably a high-voltage electronics unit, in particular a high-voltage battery 15. The high-voltage battery 15 is connected to the electrical power connections 14 of the electrical mating connector 3 via lines 38. The housing part 22 is preferably a cover of the housing 23. The electrical connector 2 is shown in FIG. 7 as part of an assembled cable 39, i.e. the assembled cable 39 comprises the electrical connector 2.

Figure 9:
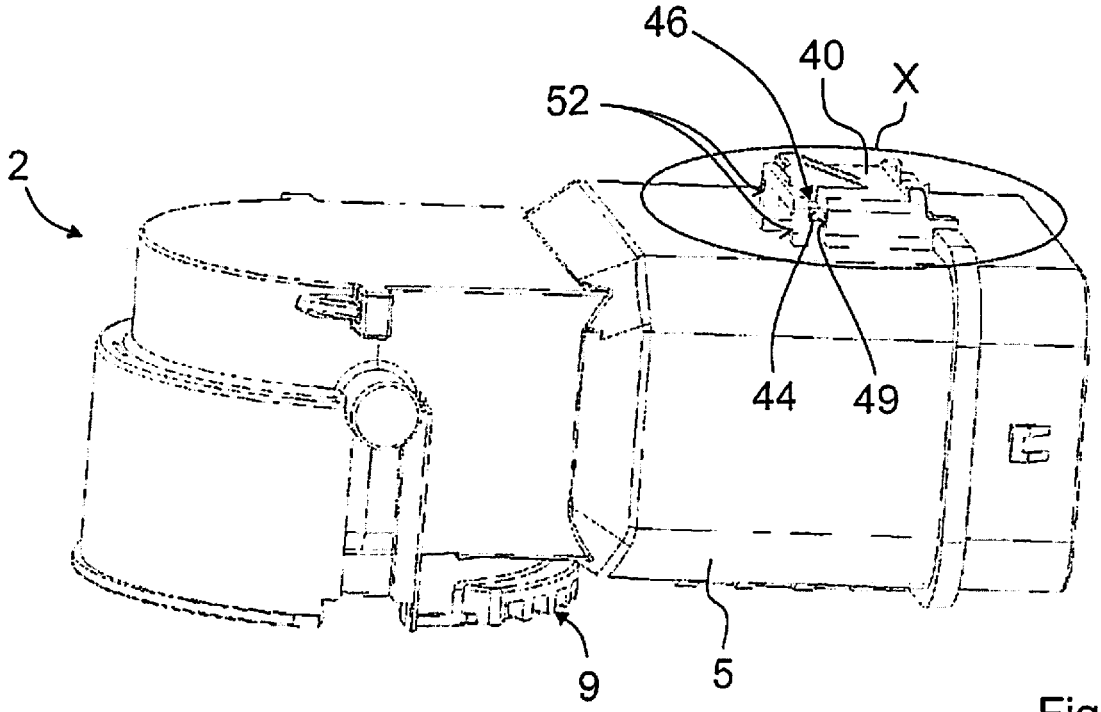
FIG. 9 is a second perspective view of the connector of FIG. 8 less the actuating lever.
Figure 16:
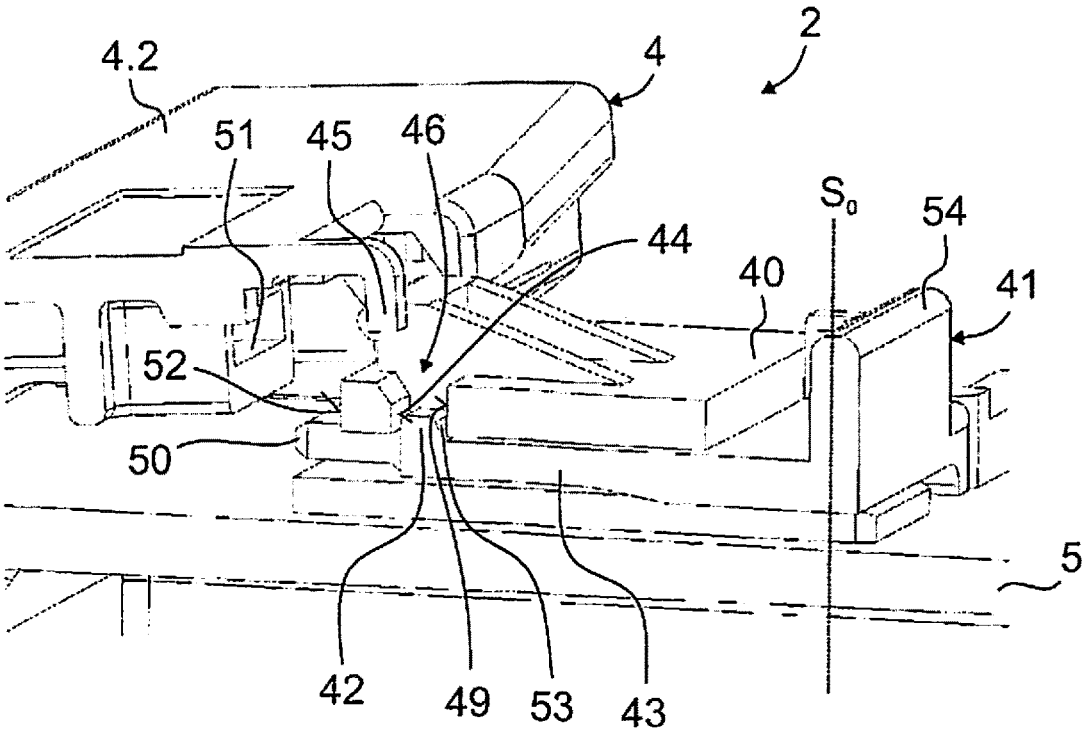
FIG. 16 is an enlarged perspective partial section view of an electrical connector with a securing element inserted in an initial position inside the locking safeguard, with a plug-in connection not yet locked.
Figure 17:
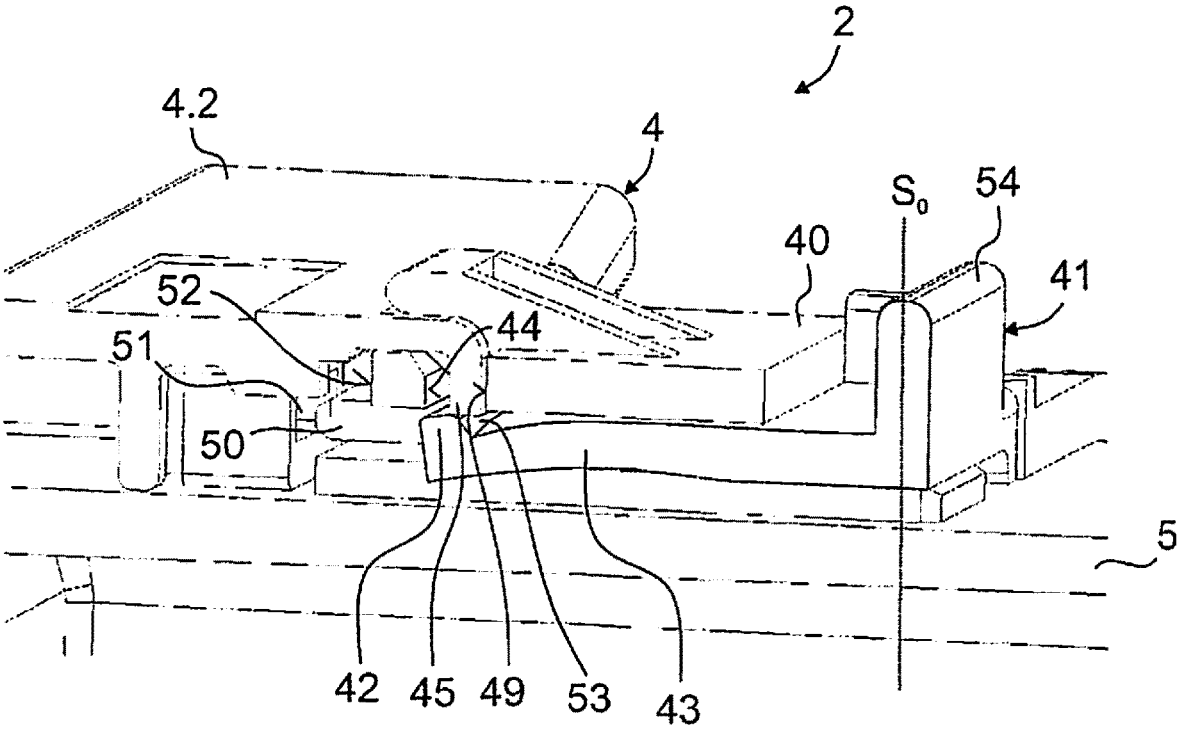
FIG. 17 is an enlarged perspective partial section view, similar to that of FIG. 16, showing the plug-in connection in a locked position.
Figure 18:
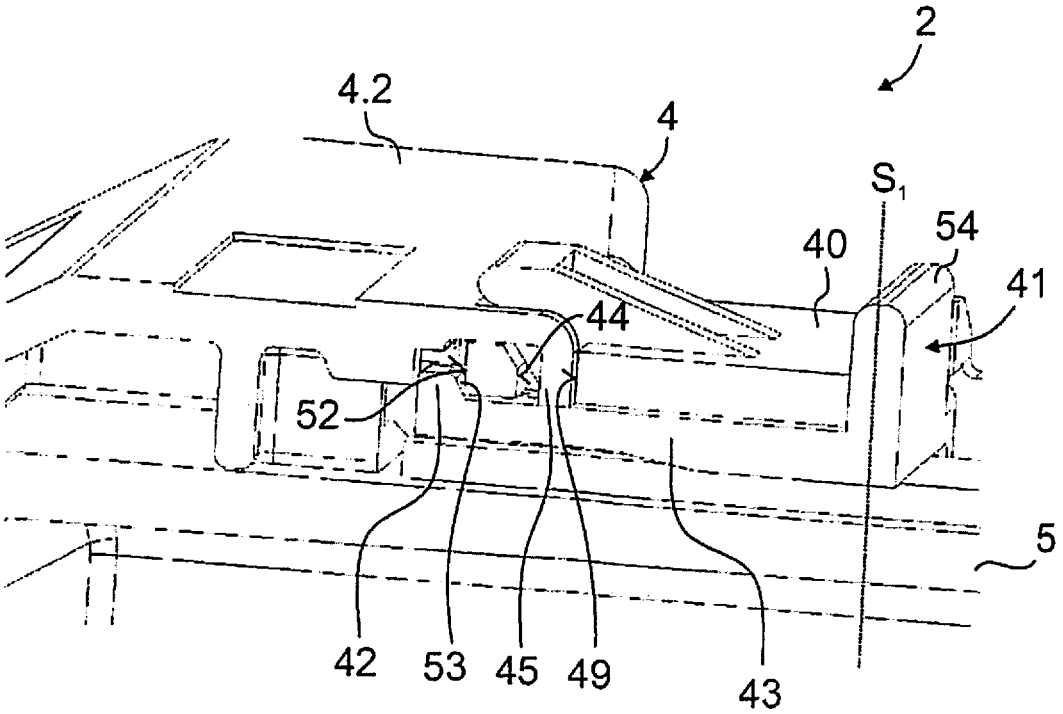
FIG. 18 is a perspective partial section view of an electrical connector with a securing element in a securing position.
Figure 19:
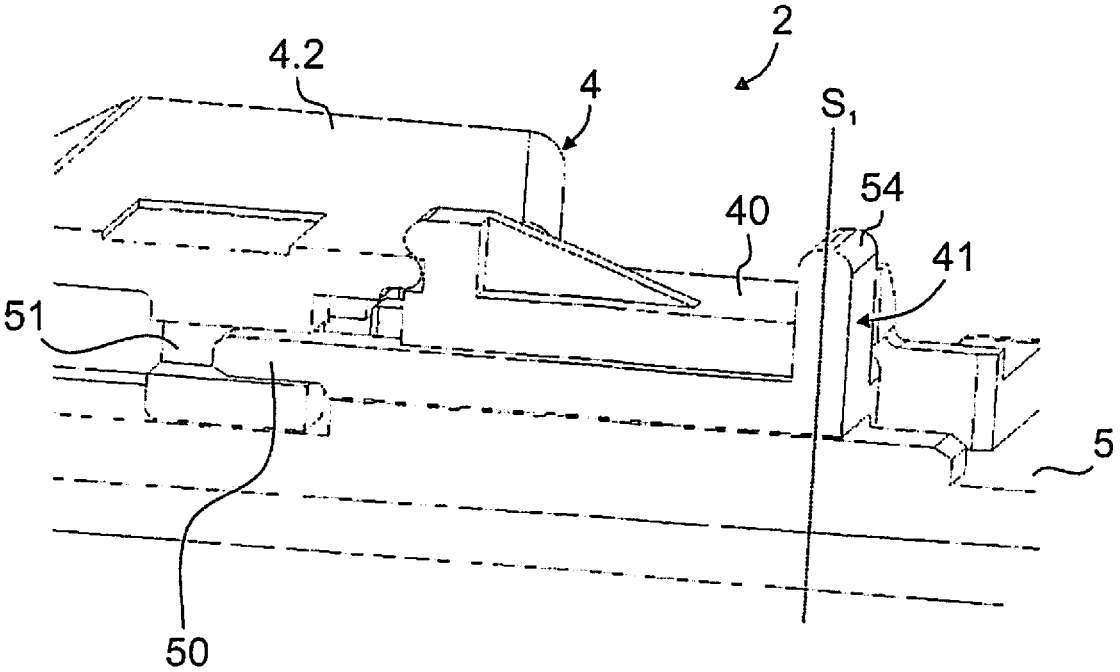
FIG. 19 is a partial section view of an electrical connector with a securing element in a securing position, showing a closure tab of the securing element, which is received in a corresponding receiver of the actuating element for the purpose of blocking the actuating lever.

FIG. 8 shows the electrical connector 2 according to the invention in an isometric overall view, and FIG. 9 shows a further view of the connector 2 with the actuating lever 4 hidden. The electrical connector 2 has a locking safeguard 40 on its connector housing 5 for guiding the securing element 41 (c.f. FIGS. 13 to 19), described below, between an initial position $S_0$ (c.f. FIGS. 16 and 17) and a securing position $S_1$ (c.f. FIGS. 18 and 19). The locking safeguard 40 is represented in enlarged form in FIG. 10, and its features are described in greater detail below.

FIGS. 16 to 19 show the method according to the invention for locking the plug-in connection 1 in various states.

FIG. 16 shows a sectional representation through the electrical connector 2 of FIG. 8 with a securing element 41 inserted into the locking safeguard 40. In FIG. 16, the securing element 41 is in the initial position $S_0$. The actuating lever 4 is also visible and has not yet been fully closed, or brought into the locking position $P_1$.

Figure 13:
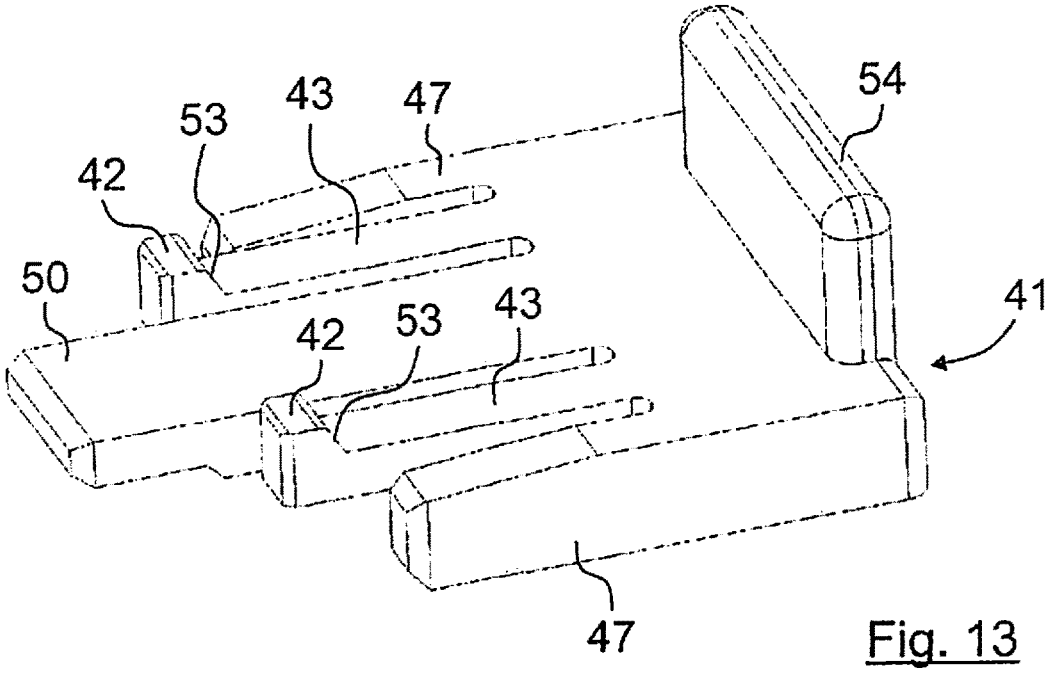
FIG. 13 is a perspective detail representation of a securing element of a connector, in a first view.
Figure 14:
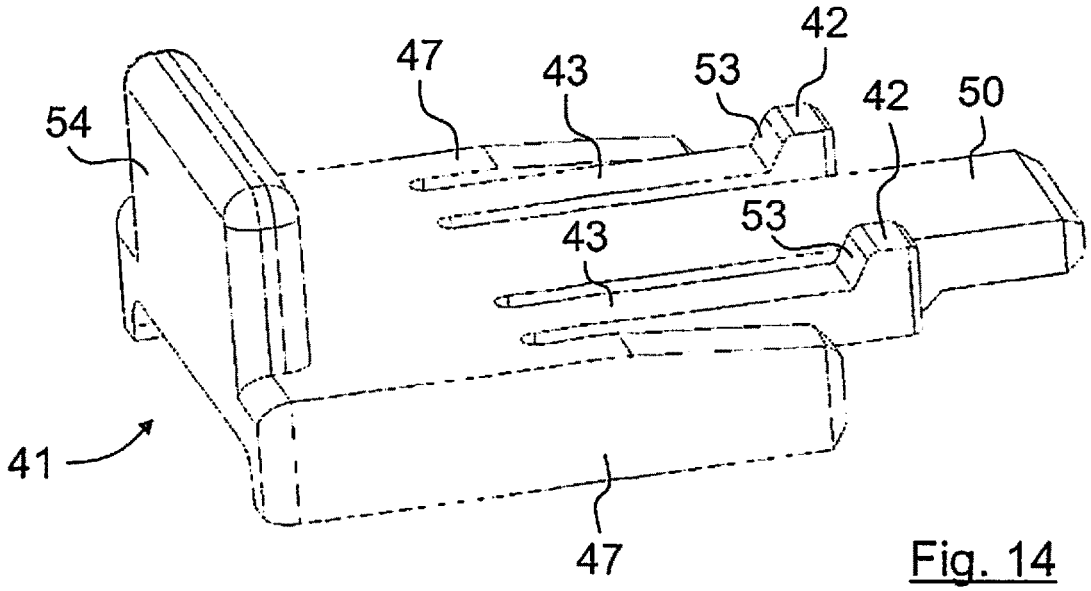
FIG. 14 is a perspective detail representation of the securing element of FIG. 13, in a second view.
Figure 15:
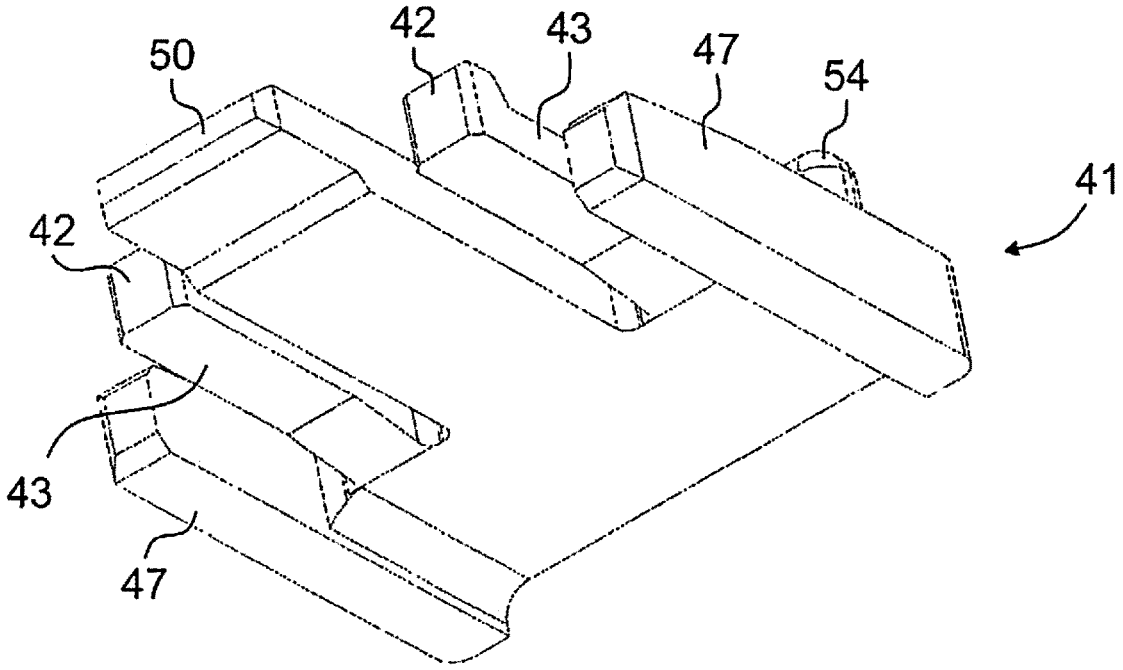
FIG. 15 is a perspective detail representation of the securing element of FIG. 13, in a third view.

The securing element is shown in FIGS. 13 to 15 in an isometric representation in various views, and has at least one latching lug 42, in this case two latching lugs 42. The latching lugs 42 are resiliently arranged at the ends of respective elastic webs 43. The combination of latching lug 42 and elastic web 43 may also be referred to as a latching hook.

The locking safeguard 40 (c.f. inter alia FIG. 10) has at least one first stop 44, in this case two first stops 44, corresponding to the latching lugs 42, in order to initially block the securing element 41, at first in the initial position $S_0$, in the direction of the securing position $S_1$, as represented in FIG. 16.

Figure 12:
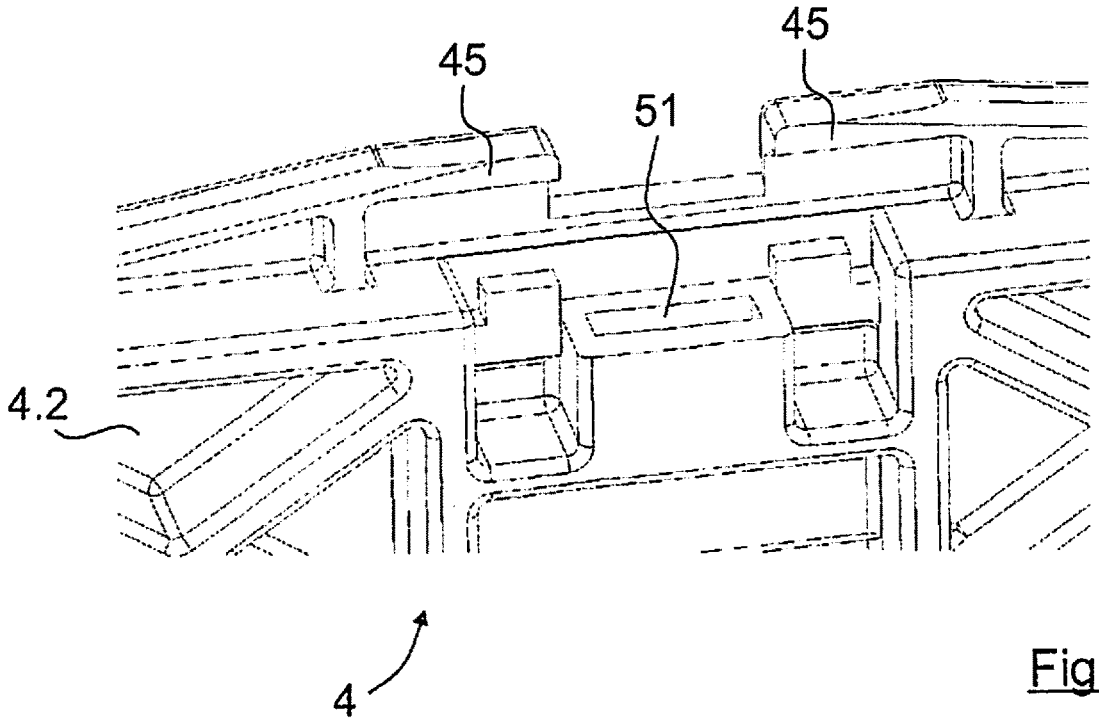
FIG. 12 is an enlarged perspective representation of the detail XII of FIG. 11.

The actuating element 4 is shown in FIG. 11 in an isometric detail representation; FIG. 12 shows the enlarged detail XII for clearer illustration. The actuating element 4 has at least one release body, in this case two actuating collars 45, which are designed to enter into a recess 46 in the locking safeguard 40 and to displace the latching lugs 42 of the securing element 41 relative to the at least one first stop 44 of the locking safeguard 40, in order to release the displacement path of the securing element 41, starting from the initial position $S_0$, into the securing position $S_1$, as represented in FIG. 17. In the exemplary embodiment the actuation collars 45 press directly against the latching lugs 42 to release the displacement path of the securing element 41, thereby bending the elastic webs 43 downwards.

Figure 10:
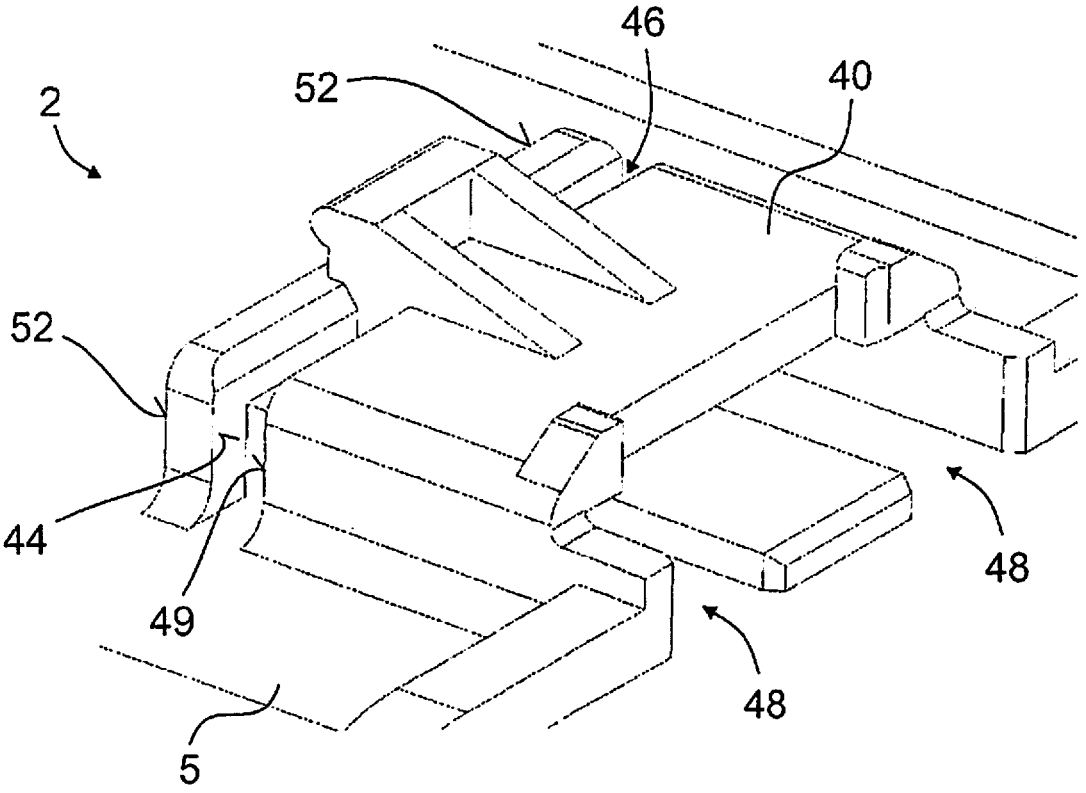
FIG. 10 is an enlarged perspective representation of the detail X, of FIG. 9.

In the exemplary embodiment a rail guide is provided to guide the securing element 41 in the locking safeguard 40. For this purpose, the securing element 41 has two guide webs 47, which are guided in corresponding guide grooves 48 of the locking safeguard 40. (FIG. 10).

As can be seen in FIG. 16, the locking safeguard 40 also realizes a loss prevention device for the securing element 41, and has two second stops 49 for this purpose.

FIGS. 18 and 19, in two sectional views through the electrical connector 2, show the securing element 41 in the securing position $S_1$. In the securing position $S_1$, the securing element 41 is in engagement with the actuating element 4, or actuating lever 4, in such a manner that the actuating lever 4 is blocked in the locking position $P_1$. As shown clearly in particular in FIG. 19, for this purpose the securing element 41 has a closure tab 50, which is at least partially received in a corresponding receiver 51 of the actuating lever 4 (c.f. in particular also FIG. 11 and FIG. 12) when the securing element 41 is in the securing position $S_1$.

Furthermore, in the exemplary embodiment the locking safeguard 40 comprises two third stops 52, which are designed to initially block the securing element 41 in the securing position $S_1$ in order to block the displacement path of the securing element 41 from the securing position $S_1$ back into its initial position $S_0$.

In order that a deliberate unlocking, or a deliberate withdrawal, of the securing element 41, and ultimately also a release of the actuating lever 4, can nevertheless be achieved, the latching lugs 42 of the securing element 41 have a bevel 53, or chamfer, on their side surface that faces away from the at least one first stop 44 of the locking safeguard 40 in the initial position $S_0$. The locking safeguard 40 can thus be reversible.

Owing to the bevel 53, in the exemplary embodiment the securing element 41 can also, if necessary, be completely removed again from the locking safeguard 40, starting from the initial position $S_0$.

In particular, in order to be able to provide the fitter with feedback regarding a correctly secured plug-in connection 1, the securing element 41 additionally has an end stop 54, which, in the securing position $S_1$, impinges against an end face of the locking safeguard 40.

OPERATION

Having described the structure of my electrical connector 2 and plug-in connection 1, high voltage system and method for locking an electrical plug-in connection 1, its operation is briefly described.

An electrical connector 2 is provided, the electrical connector 2 having, a connector housing 5, the conductor housing 5 having a locking safeguard 40, and the locking safeguard 40 has a first stop 44, and defines a recess 46, a securing element 41 that is guided by the connector housing locking safeguard 40 and movable between an initial position $S_0$, and a securing position $S_1$, the securing element 41 further having a latching lug 42 that communicates with the first stop 44 of the locking safeguard 40 to block the securing element 41 in the initial position $S_0$, an actuating element 4 that is carried by the connector housing 5 and is movable between a home position $P_0$, and a locking position $P_1$, to lock the electrical connector 2 to the electrical mating connector 3, and the actuating element 4 has a release body, which enters the recess 46 defined in the locking safeguard 40 to displace the latching lug 42 of the securing element 41 relative to the first stop 44 of the locking safeguard 40, so that the securing element 41 may be displaced, along a displacement path, between the initial position $S_0$ and the securing position $S_1$, and the securing element 41, when in the securing position $S_1$, blocks the actuating element 4 in the locking position $P_1$; and providing an electrical mating connector 3, the electrical mating connector 3 corresponding to the electrical connector 2 and the electrical mating connector 3 has a guide means 6, which acts in combination with actuating element 4 of the electrical connector 2 and the guide means 6 is movable between a home position $P_0$ and a locking position $P_1$ so that the actuating element 4, starting from a pre-latching position, assumes a locking position $P_1$ with the electrical mating connector 3 when the actuating element 4 is moved from the home position $P_0$ into the locking position $P_1$; positioning the electrical connector 2 and the electrical mating connector 3 in a pre-latching position, so that the electrical connector 2 and the electrical mating connector 3 can be brought into a locking position $P_1$; moving the actuating element 4 from a home position $P_0$ into a locking position $P_1$, wherein the actuating element 4 acts in combination with the guide means 6 of the electrical mating connector 3, and wherein the release body of the actuating element 4 enters the recess 46 defined in the locking safeguard 41 and responsively displaces the latching lug 42 of the securing element 41 relative to the first stop 46 of the locking safeguard 41 so as to release displacement of the securing element 41 from the initial position $S_0$, into the securing position $S_1$ when the actuating element 4 is in the locking position $P_1$ and moving the securing element 41 from the initial position $S_0$ into the securing position $S_1$ so that the securing element 41 engages with the actuating element 4 so that the actuating element 4 is blocked in the locking position $P_1$.

It is an object of the present invention to provide an electrical connector 2 comprising: a connector housing 5, the conductor housing 5 having a locking safeguard 40, and the locking safeguard 40 has a first stop 44, and defines a recess 46; a securing element 41 that is guided by the connector housing locking safeguard 40 and movable between an initial position $S_0$, and a securing position $S_1$, the securing element 41 further having a latching lug 42 that communicates with the first stop 44 of the locking safeguard 40 to block the securing element 41 in the initial position $S_0$; an actuating element 4 that is carried by the connector housing 5 and is movable between a home position $P_0$, and a locking position $P_1$, to lock the electrical connector 2 to a corresponding electrical mating connector 3, and the actuating element 4 has a release body, which enters the recess 46 defined in the locking safeguard 40 to displace the latching lug 42 of the securing element 41 relative to the first stop 44 of the locking safeguard 40, so that the securing element 41 may be displaced, along a displacement path, between the initial position $S_0$ and the securing position $S_1$; and the securing element 41, when in the securing position $S_1$, blocks the actuating element 4 in the locking position $P_1$.

It is a further object of the present invention to provide an electrical connector 2 wherein, the release body of the actuating element 4 is positioned to be pressed against the latching lug 42 to displace the latching lug 42 relative to the first stop 44 of the locking safeguard 40 to allow displacement of the securing element 41 along the displacement path.

It is a further object of the present invention to provide an electrical connector 2 comprising a second stop 44 carried by the locking safeguard 40, and the second 44 stop is a loss prevention device for the securing element 41.

It is a further object of the present invention to provide an electrical connector 2 comprising a third stop 44 carried by the locking safeguard 40, and the third stop 44 blocks the securing element 41 in the securing position $S_1$, and in particular blocks displacement of the securing element 41 from the securing position $S_1$ back to the initial position $S_0$.

It is a further object of the present invention to provide an electrical connector 2 wherein the latching lug 42 has a side surface, and the side surface has a bevel and/or chamfer 53 that faces away from the first stop 44 of the locking safeguard 40 when the securing element 41 is in the initial position $S_0$.

It is a further object of the present invention to provide an electrical connector 2 comprising a closure tab 50 carried by the securing element 41; and the closure tab 50 is at least partially received in a corresponding receiver 51 of the actuating element 4 when the securing element 41 is in the securing position $S_1$.

It is a further object of the present invention to provide an electrical connector 2 wherein, the securing element 41 is guided in the locking safeguard 40 by a rail guide 10.

It is a further object of the present invention to provide an electrical connector 2 comprising two latching lugs 42 on the securing element 41; and two first stops 44 on the locking safeguard 40 for the two latching lugs 42; and two release bodies on the actuating element 4 for displacing the two latching lugs 42.

It is a further object of the present invention to provide an electrical connector 2 comprising a closure tab 50 carried by the securing element 41; and the closure tab 50 extends between the two latching lugs 42.

It is a further object of the present invention to provide an electrical connector 2 comprising a guide lug 6 carried by the electrical mating connector 3; and the actuating element 4 is realized as an actuating lever/link guide, and releasably engages with the guide lug 6 carried by the electrical mating connector 3.

It is a further object of the present invention to provide an electrical plug-in connection 1 comprising an electrical connector 2; and an electrical mating connector 3; the electrical connector 2 has, a connector housing 5, the conductor housing 5 having a locking safeguard 40, and the locking safeguard 40 has a first stop 44, and defines a recess 46, a securing element 41 that is guided by the connector housing 5 locking safeguard 40 and movable between an initial position $S_0$, and a securing position $S_1$, the securing element 41 further having a latching lug 42 that communicates with the first stop 44 of the locking safeguard 40 to block the securing element 41 in the initial position $S_0$, an actuating element 4 that is carried by the connector housing 5 and is movable between a home position $P_0$, and a locking position $P_1$, to lock the electrical connector 2 to the electrical mating connector 3, and the actuating element 4 has a release body, which enters the recess 46 defined in the locking safeguard 40 to displace the latching lug 42 of the securing element 40 relative to the first stop 44 of the locking safeguard 40, so that the securing element 41 may be displaced, along a displacement path, between the initial position $S_0$ and the securing position $S_1$, and the securing element 41, when in the securing position $S_1$, blocks the actuating element 4 in the locking position $P_1$; and the electrical mating connector 3 corresponds to the electrical connector 2 and the electrical mating connector 3 has a guide means 6, which acts in combination with actuating element 4 of the electrical connector 2 and is movable between a home position $P_0$ and a locking position $P_1$ so that the actuating element 4, starting from a pre-latching position, assumes a locking position $P_1$ with the electrical mating connector 3 when the actuating element 4 is moved from the home position $P_0$ into the locking position $P_1$.

It is a further object of the present invention to provide an electrical plug-in connection 1 comprising toothing 9 carried by the electrical connector 2; and mating toothing 8 carried by the electrical mating connector 3 that corresponds to the toothing 9 of the electrical connector 2; and wherein the toothing 9 and the mating toothing 8 are in engagement with each other when the actuating element 4 is in the locking position $P_1$.

It is a further object of the present invention to provide an electrical plug-in connection 1 comprising a connector body of the electrical mating connector 3, and the connector body is configured to receive a contact means 13 therein; and shielding 18 carried by the connector body; and the connector body is insertable into an opening 21 defined in a housing part 22 of a housing 23 of an electronics unit 15; and the connector body comprises an inner connector body 11 and an outer connector body 12 and the inner connector body 11 and the outer connector body 12 are positioned on opposite sides of the housing part; 22 and the inner connector body 11 can be fixed in the housing 23 of the electronics unit 15, independently of the housing part 22; and fastening means 25 connect the inner and outer connector bodies 11, 12 to each another in such a manner that the housing part 22 is fixed between the inner and outer connector bodies 11, 12.

It is a further object of the present invention to provide a high-voltage system, in particular for a motor vehicle, comprising an electrical connector 2, the electrical connector 2 having, a connector housing 5, the conductor housing 5 having a locking safeguard 40, and the locking safeguard 40 has a first stop 44, and defines a recess 46, a securing element 41 that is guided by the connector housing locking safeguard 40 and movable between an initial position $S_0$, and a securing position $S_1$, the securing element 41 further having a latching lug 42 that communicates with the first stop 44 of the locking safeguard 40 to block the securing element 41 in the initial position $S_0$, an actuating element 4 that is carried by the connector housing 5 and is movable between a home position $P_0$, and a locking position $P_1$, to lock the electrical connector 2 to the electrical mating connector 3, and the actuating element 4 has a release body, which enters the recess 46 defined in the locking safeguard 40 to displace the latching lug 44 of the securing element 41 relative to the first stop 44 of the locking safeguard 40, so that the securing element 41 may be displaced, along a displacement path, between the initial position $S_1$ and the securing position $S_1$, and the securing element 41, when in the securing position $S_1$, blocks the actuating element 4 in the locking position $P_1$; and a housing 23 having a high-voltage electronic unit 15; the housing 23 having a housing part 22 to which an electrical mating connector 3 is fixed; and the electrical mating connector 3 is configured for connection to the electrical connector 2.

It is a further object of the present invention to provide an electrical connector 2 comprising a corresponding guide groove 48 defined in the locking safeguard 40; and a guide web 47 carried by the securing element 41; and the securing element 41 is movably guided in the locking safeguard 40 by the guide web 47 that is movably guided by the corresponding guide groove 48.

In compliance with the statute, the present invention has been described in language more or less specific as to the structural and methodical features. It is to be understood, however, that the invention is not limited to the specific features shown and described since the means herein disclosed comprise preferred forms of putting the invention into effect. The invention is therefore claimed, in any of its forms or modifications, within the proper scope of the appended claims appropriately interpreted in accordance with the doctrine of equivalents.

We claim:

1. An electrical connector comprising:

a connector housing having a locking safeguard, and the locking safeguard has a first stop and defines a recess;

a securing element that is guided by the locking, safeguard of the connector housing and movable between an initial position and a securing position, the securing element further having a latching lug that communicates with the first stop of the locking safeguard to block the securing element in the initial position;

an actuating element that is carried by the connector housing and is movable between a home position and a locking position in an arc of movement about a pair of pivot axles carried on opposing side portions of the connector housing, to lock the electrical connector to a corresponding electrical mating connector, and the actuating element has a release body, that enters the recess defined in the locking safeguard to displace the latching lug of the securing element relative to the first stop of the locking safeguard, so that the securing element may be displaced, along a displacement path, between the initial position which is distal from the pair of pivot axles, and the securing position which is less distal from the pair of pivot axles; and the securing element, when in the securing position, blocks the actuating element in the locking position.

2. The electrical connector as claimed in claim 1 and wherein, the release body of the actuating element, is positioned to be pressed against the latching lug to displace the latching lug relative to the first stop of the locking safeguard to allow displacement of the securing element along the displacement path.

3. The electrical connector as claimed in claim 1 and further comprising:

a second stop carried by the locking safeguard, and the second stop is a loss prevention device for the securing element.

4. The electrical connector as claimed in claim 3 and further comprising:

a third stop carried by the locking safeguard, and the third stop blocks the securing element in the securing position, and in particular blocks displacement of the securing element from the securing position back to the initial position.

5. The electrical connector as claimed in claim 1 and wherein the latching lug has a side surface, and the side surface has a bevel and/or chamfer that faces away from the first stop of the locking safeguard when the securing element is in the initial position.

6. The electrical connector as claimed in claim 1 and further comprising:

a closure tab carried by the securing element; and the closure tab is at least partially received in a corresponding receiver of the actuating element when the securing element is in the securing position.

7. The electrical connector as claimed in claim 1 and wherein, the securing element is guided in the locking safeguard by a rail guide.

8. The electrical connector as claimed in claim 1 and further comprising:

two latching lugs on the securing element; and two first stops on the locking safeguard for the two latching lugs; and two release bodies on the actuating element for displacing the two latching lugs.

9. The electrical connector as claimed in claim 8 and further comprising:

a closure tab carried by the securing element; and the closure tab extends between the two latching lugs.

10. The electrical connector as claimed in claim 1 and further comprising:

a guide lug carried by the electrical mating connector; and the actuating element is realized as an actuating lever/link guide, and releasably engages with the guide lug carried by the electrical mating connector.

11. The electrical connector as claimed in claim 1 and further comprising:

a corresponding guide groove defined in the locking safeguard; and a guide web carried by the securing element; and the securing element is movably guided in the locking safeguard by the guide web that is movably guided by the corresponding guide groove.

12. An electrical plug-in connection comprising:

an electrical connector; and an electrical mating connector; and the electrical connector has, a connector housing having a locking safeguard, and the locking safeguard has a first stop and defines a recess, a securing element that is guided by the connector housing and movable between an initial position and a securing position, the securing element further having a latching lug that communicates with the first stop of the locking safeguard to block the securing element in the initial position, an actuating element that is carried by the connector housing and is movable between a home position and a locking position, to lock the electrical connector to the electrical mating connector, and the actuating element has a release body, that enters the recess defined in the locking safeguard to displace the latching lug of the securing element relative to the first stop of the locking safeguard, so that the securing element is movable, along a displacement path, between the initial position and the securing position, and the securing element, when in the securing position, blocks the actuating element in the locking position; and the electrical mating connector corresponds to the electrical connector and the electrical mating connector has at least one guide lug, that acts in combination with the actuating element of the electrical connector and the actuation element is movable in an arc of movement between the home position and the locking position so that the electrical connector, starting from a pre-latching position, assumes a locking position with the electrical mating connector when the actuating element is moved through the arc of movement from the home position into the locking position; and a connector body of the mating connector, and the connector body is configured to receive a contact means therein; and shielding carried by the connector body; and the connector body is insertable into an opening defined in a housing part of a housing of an electronics unit; and the connector body comprises an inner connector body and an outer connector body and the inner connector body and the outer connector body are positioned on opposite sides of the housing part; and the inner connector body is fixed in the housing of the electronics unit, independently of the housing part; and fastening means connect the inner and outer connector bodies to each another in such a manner that the housing part is fixed between the inner and outer connector bodies.

13. The electrical plug-in connection as claimed in claim 12 and further comprising:

toothing carried by the electrical connector, and the toothing is arranged on a single surface of the electrical connector around a central axis of the electrical connector; and mating toothing carried by the electrical mating connector, and the mating toothing is arranged on a single surface of the electrical mating connector around a central axis of the electrical mating connector and the mating toothing corresponds to the toothing of the electrical connector; and wherein the toothing and the mating toothing are in engagement with each other when the actuating element is in the locking position.

14. The electrical connector as claimed in claim 12 and further comprising:

two latching lugs on the securing element; and two first stops on the locking safeguard for the two latching lugs; and two release bodies on the actuating element for displacing the two latching lugs.

15. The electrical connector as claimed in claim 14 and further comprising:

a closure tab carried by the securing element; and the closure tab extends between two latching lugs carried by the securing element.

16. The electrical connector as claimed in claim 12 and further comprising:

a guide lug carried by the electrical mating connector; and the actuating element is realized as an actuating lever/link guide, and releasably engages with the guide lug carried by the electrical mating connector.

17. The electrical connector as claimed in claim 12 and further comprising:

a closure tab carried by the securing element; and the closure tab is at least partially received in a corresponding receiver of the actuating element when the securing element is in the securing position.

18. A high-voltage system, in particular for a motor vehicle, comprising:

an electrical connector, the electrical connector having, a connector housing having a locking safeguard, and the locking safeguard has a first stop and defines a recess, a securing element that is guided by the locking safeguard of the connector housing and movable between an initial position and a securing position, the securing element further having a latching lug that communicates with the first stop of the locking safeguard to block the securing element in the initial position, an actuating element that is carried by the connector housing and is movable between a home position and a locking position in an arc of movement about a pair of pivot axles carried on opposing side portions of the connector housing, to lock the electrical connector to the electrical mating connector, and the actuating element has a release body, that enters the recess defined in the locking safeguard to displace the latching lug of the securing element relative to the first stop of the locking safeguard, so that the securing element is displaced, along a displacement path, between the initial position which is distal from the pair of pivot axles, and the securing position which is toward the pair of pivot axle, and the securing element, when in the securing position and positioned toward the pair of pivot axles, blocks the actuating element in the locking position; and a housing having a high voltage electronic unit;

the housing having a housing part to which an electrical mating connector is fixed; and the electrical mating connector is configured for connection to the electrical connector.

19. A method for locking an electrical plug-in connection comprising the steps:

providing an electrical connector, the electrical connector having, a connector housing having a locking safeguard, and the locking safeguard has a first stop and defines a recess, a securing element that is guided by the connector housing and movable between an initial position and a securing position, the securing element further having a latching lug that communicates with the first stop of the locking safeguard to block the securing element in the initial position, an actuating element that is carried by the connector housing and is movable between a home position and a locking position in an arc of movement about a pair of pivot axles carried on opposing side portions of the connector housing, to lock the electrical connector to the electrical mating connector, and the actuating element has a release body, that enters the recess defined in the locking safeguard to displace the latching lug of the securing element relative to the first stop of the locking safeguard, so that the securing element is displaced, along a displacement path, between the initial position which is distal from the pair of pivot axles, and the securing position which is toward the pair of pivot axles, and the securing element, when in the securing position and positioned toward the pair of pivot axles, blocks the actuating element in the locking position; and providing a mating connector, the mating connector corresponding to the electrical connector and the electrical mating connector has a guide means, that acts in combination with the actuating element of the electrical connector as the actuating element is moved through the arc of movement between the home position and the locking position so that the electrical connector, starting from a pre-latching position, assumes a locking position with the electrical mating connector when the actuating element is moved from the home position into the locking position;

positioning the electrical connector and the electrical mating connector in a pre-latching position, wherein the actuating element is positioned in the home position;

moving the actuating element through the arc of movement from the home position into the locking position, wherein the actuating element acts in combination with the guide means of the electrical mating connector, and wherein the release body of the actuating element enters the recess defined in the locking safeguard and responsively displaces the latching lug of the securing element relative to the first stop of the locking safeguard so as to release displacement of the securing element from the initial position, into the securing position when the actuating element is in the locking position; and moving the securing element along a displacement path from the initial position, which is distal from the pair of pivot axles, into the securing position, which is toward the pair of pivot axles, so that the securing element engages with the actuating element so that the actuating element is blocked in the locking position.

20. An electrical plug-in connection comprising:

an electrical connector; and an electrical mating connector; and the electrical connector has, a connector housing having a locking safeguard, and the locking safeguard has a first stop and defines a recess, a securing element that is guided by the connector housing and movable between an initial position and a securing position, the securing element further having a latching lug that communicates with the first stop of the locking safeguard to block the securing element in the initial position, an actuating element that is carried by the connector housing and is movable between a home position and a locking position, to lock the electrical connector to the electrical mating connector, and the actuating element has a release body, that enters the recess defined in the locking safeguard to displace the latching lug of the securing element relative to the first stop of the locking safeguard, so that the securing element is displaced, along a displacement path, between the initial position and the securing position, and the securing element, when in the securing position, blocks the actuating element in the locking position; and the electrical mating connector corresponds to the electrical connector and the electrical mating connector has at least one guide lug, that acts in combination with the actuating element of the electrical connector and the actuation element is movable between the home position and the locking position so that the electrical connector, starting from a pre-latching position, assumes a locking position with the electrical mating connector when the actuating element is moved from the home position into the locking position; and toothing carried by the electrical connector, and the toothing is arranged on a single surface of the electrical connector and around a central axis of the electrical connector; and mating toothing carried by the electrical mating connector, and the mating toothing is arranged on a single surface of the electrical mating connector and around a central axis of the electrical mating connector that corresponds to the toothing of the electrical connector; and wherein the toothing and the mating toothing are in engagement with each other and the single toothing carrying surface of the electrical connector and the single toothing carrying surface of the electrical mating connector are immediately adjacent one another when the actuating element is in the locking position.

* * * * *